United States Patent [19]

Wells

[11] 4,135,488

[45] Jan. 23, 1979

[54] FIREPLACE FURNACE APPARATUS

[76] Inventor: William T. Wells, 3930 W. Ajo Way, Tucson, Ariz. 85713

[21] Appl. No.: 769,384

[22] Filed: Feb. 16, 1977

[51] Int. Cl.[2] ..... F24B 7/00

[52] U.S. Cl. ..... 126/121; 126/122; 126/125; 126/177; 126/164

[58] Field of Search ..... 126/121, 122, 143, 164, 126/177, 158, 162, 245, 152 B; 237/51

[56] References Cited

U.S. PATENT DOCUMENTS

| | | | |
|---|---|---|---|
| 575,487 | 1/1897 | May | 126/177 |
| 642,197 | 1/1900 | Bender | 126/122 |
| 926,436 | 7/1909 | Horst | 126/162 X |
| 2,453,954 | 11/1948 | Wright | 126/122 X |
| 2,470,430 | 5/1949 | Carter | 126/143 |
| 3,926,174 | 12/1975 | Bell | 126/121 |
| 3,976,048 | 8/1976 | Ashman, Sr. | 126/143 |
| 4,026,263 | 5/1977 | Boyd | 126/121 |
| 4,059,090 | 11/1977 | Shaw | 126/121 |
| 4,061,127 | 12/1977 | Fisher | 126/202 X |

FOREIGN PATENT DOCUMENTS

| | | | |
|---|---|---|---|
| 249608 | 2/1964 | Australia | 126/121 |

*Primary Examiner*—William F. O'Dea
*Assistant Examiner*—Harold Joyce
*Attorney, Agent, or Firm*—H. Gordon Shields

[57] ABSTRACT

Fireplace apparatus is disclosed in which combustion air is obtained from outside the structure in which the apparatus is installed and the apparatus is sealed from the structure in which it is installed and the heat from the fireplace is collected from around the fireplace and from above the fireplace in the chimney flue for transmission to other parts of the structure in which the fireplace furnace apparatus is installed for heating purposes.

11 Claims, 21 Drawing Figures

FIREPLACE FURNACE APPARATUS

BACKGROUND OF THE INVENTION

1. Field of the Invention

This invention relates to combustion heating apparatus, and, more particularly, to fireplace furnace apparatus in which the aesthetic appearance of a fireplace and the ability of the fireplace to burn relatively inexpensive wood is preserved and combined with the benefit of a furnace for heat collection and distribution throughout a structure in which the apparatus is installed.

2. Background of the Invention

Fireplaces have been used for many centuries. The original purpose of a fireplace was to provide heat for warming a structure, and to provide heat for cooking. There are obvious advantages to fireplaces, such as the ease of starting a fire and of adding fuel to the fire. Moreover, the fireplace burns primarily wood, which is a relatively plentiful and relatively inexpensive fuel.

When stoves were developed, they replaced fireplaces as a primary source of heat for cooking. In many instances, stoves, in conjunction with fireplaces, were used as the primary source of heat to heat a structure. When central heating units or furnaces were developed with duct work and, later, with forced air blowers powered by electric motors, fireplaces and stoves were replaced as the primary source of heat for heating a structure. Fireplaces then became primarily used for aesthetic purposes, rather than for functional purposes. They did, of course, provide heat for a room in which they were installed in a structure, but the heat thus provided, which is typical of fireplaces, is not evenly distributed throughout the room, and is a relatively inefficient source of heat. Most of the heat escapes up the chimney flue with the combustion gases.

One of the inherent problems with fireplaces of the prior art is that they require air (oxygen) for combustion and the air is drawn from the room in which the fireplace is installed. This means that in addition to radiating heat outwardly into the room, the heated air is in turn drawn back into the fireplace to provide the necessary oxygen for combustion.

Over the years, various designs of fireplaces have been developed to increase the efficiency of fireplaces as a source of heat. The most common design in use includes a structural metal interior shell, which comprises the fireplace box in which combustion takes place, with a space about the metal box and the space communicates with the room through a series of vents. The vents are typically situated relatively low and relatively high with respect to the fireplace. The cooler air from the room is drawn through the lower vents, heated from the fireplace, and circulates outwardly through the upper vents into the room. The air flows by natural convection of the heated air. However, such an arrangement, while producing generally more usable heat for the room in which the fireplace is installed, still draws back from the room the heated air for combustion purposes.

Prior art fireplaces use andirons to support fuel for burning. The fuel, generally wood logs, is disposed on the andirons for combustion pusposes. Air for combustion is typically drawn into the fireplace, both beneath the andirons, and accordingly upwardly through the fire, and directly into the fireplace and over the fuel burning on the andirons. The ashes or residue from the combustion of the fuel drops through the andirons and either onto the floor of the fireplace or into a bin for removal. The fuel, such as wooden logs, is accordingly disposed above the ashes so that the ashes will not smother or in any way hinder the combustion of the fuel on the andirons.

From open fireplaces, stoves are an evolutionary improvement for both heating and cooking purposes. The fire is enclosed in a metal enclosure which radiates heat outwardly and a surface is provided on which cooking utensils may be disposed. A grate is substituted for andirons for supporting fuel for combustion. Intake air may be carefully controlled to control combustion. The intake air may be more accurately contained than in an open fireplace and combustion may accordingly be more efficiently controlled.

Grates are more efficient and effective than andirons in holding fuel for combustion. However, fireplaces of the prior art do not incorporate a grate structure, as does the present apparatus.

There are potential problems with grate designs, however simple they may seem to be. For example, the spacing is an important consideration. The spacing determines the size of the burning particles of fuel which will fall through the grate. The larger the spacing, the larger the particles of fuel that will fall, and the smaller the spacing, the more the fuel will be burned before falling through the grates. On the other hand, if the space is too small, then there is a possibility, or even a likelihood, that the grate will become clogged with ashes and will cease to function as a grate should by letting ashes fall through.

A compromise to achieve the benefits of both types of grate systems has been to develop a movable grate in which the grate itself may be pivoted to allow the ashes and other burned residue to fall therethrough, or it may have the individual elements comprising the grates movable and by rotation or movement of the elements to allow the burned residue and ashes to fall therethrough.

To increase the efficiency of fireplaces, various designs have been employed, such as shown in U.S. Pat. Nos. 2,258,882 and 2,322,016. Convection currents are utilized in both patents to increase the efficiency of the heating by using the fireplace to heat auxiliary air moved around the fireplace structure. U.S. Pat. No. 2,789,554 also utilizes auxiliary air flow to increase the efficiency of a fireplace in inserting ductwork around the fireplace and above the fireplace in the chimney flue area. However, the three patents still utilize room air for combustion.

U.S. Pat. No. 3,845,754 is another version of attempts to overcome the deficiency of a fireplace by sealing the fireplace from the room in which it is installed and drawing combustion air from outside. This patent illustrates a concept of dual air flow paths, one path for combustion air and another path for heated air.

The present invention uses a dual path concept, and utilizes forced air to maximize the efficiency of the heat produced by combustion within the fireplace.

SUMMARY OF THE INVENTION

The fireplace furnace apparatus disclosed and claimed herein provides a dual path for air flow, one path for combustion air and another path for heated air. The combustion air is drawn from exteriorally of the building or structure in which the fireplace is installed and the heated air is circulated about the fire box, through a heating duct system and through the chimney flue of the apparatus to provide heat for heating the structure, in addition to the room in which the apparatus is installed. A grate system allows ashes and residue from the combustion within the fireplace to be removed exteriorally of the structure through the same channel that passes the combustion air.

Among the objects of the present invention are the following:

To provide new and useful fireplace apparatus;

To provide new and useful fireplace apparatus having a dual air flow path system;

To provide new and useful fireplace having air chambers about the fireplace for heating air;

To provide new and useful fireplace apparatus having a circulating air system;

To provide new and useful fireplace apparatus having heat exchangers about which combustion air flows to heat circulated air;

To provide new and useful fireplace apparatus having an air flow through hollow grates; and To provide new and useful fireplace apparatus having movable grates for dumping ashes that may be controlled from externally of the fireplace.

DESCRIPTION OF THE PREFERRED EMBODIMENT

Figure 1:
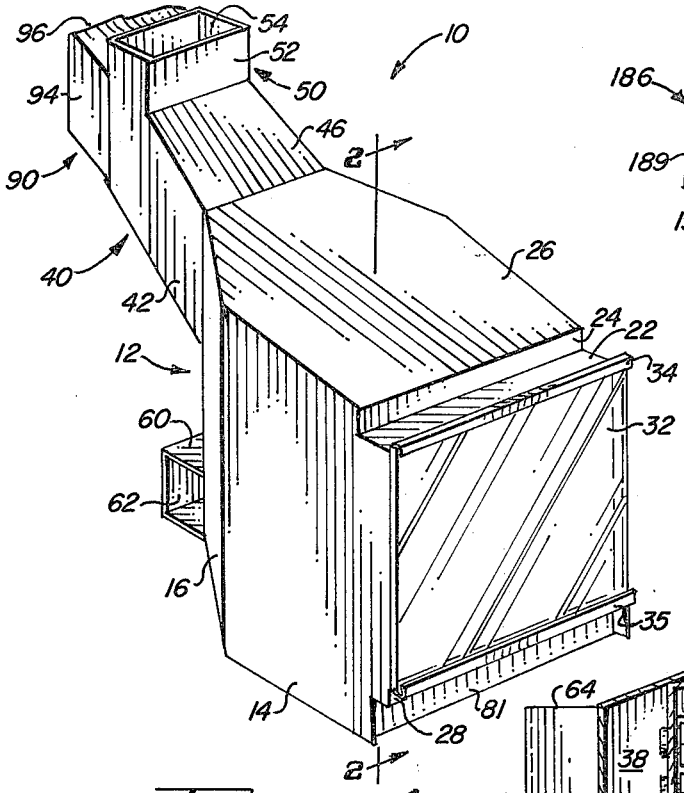
FIG. 1 is a perspective view of fireplace apparatus of the present invention.

FIG. 1 is a perspective view of fireplace apparatus 10 of the present invention. The fireplace apparatus 10 includes an outer enclosure 12 disposed about an inner enclosure, as shown and discussed in conjunction with FIGS. 2 and 3, below. The outer or outside enclosure 12 includes a left front side 14, a left rear side 16, and a like pair of side members on the right side. The side members are connected together by a top 26. At the front of the fireplace apparatus 10 is a glass front 32 which is disposed and guided, at its top and bottom edges, in appropriate guides or channels 34 and 35, respectively. The glass front is disposed in the guides and the guides are in turn secured to the outer enclosure 12. At the top portion of the guide channel 34 is a top front shelf 22 which extends rearwardly from the front of the fireplace apparatus for only a short distance. A top vertical panel 24 extends upwardly for a short distance substantially perpendicular to the top front shelf 22. The top 26 extends rearwardly and upwardly from the top vertical panel 24.

Beneath the guide 35 of the glass front 32 is a bottom support 28. The support 28 comprises a piece of angle iron which extends fully the width of the outside enclosure 12. The guide channel 35 is secured to the support 28.

The air jacket or housing 12 which surrounds the inner enclosure or firebox includes two ducts, an upper duct 40 and a lower duct 60. The upper duct 40 extends upwardly from the rear of the jacket or housing and joins onto the top 26 of the enclosure 12. The outer duct 40 includes a left side 42 and a right side 44 (see FIG. 2) which is substantially parallel to the left side 42, a top 46 which extends upwardly from the top 26 of the outer housing enclosure 12, and an upwardly and laterally extending top duct 50. The duct 50 extends upwardly from the outer portion of the top 46 of the upper duct 40 and it is substantially rectangular in configuration. The upper duct 40 is secured to the outer enclosure 12 and serves to carry circulated air for heat exchange purposes.

Lower duct 60 is secured to the back of the outer enclosure 12. It includes a pair of apertures, comprising open ends. Aperture 62, which is the open left end, is shown in FIG. 1. The lower duct 60 is disposed at the bottom of the outer enclosure 12.

Extending upwardly and outwardly from the upper duct 40 is a duct or flue for combustion gases from the firebox within the outer enclosure 12. The firebox is defined within an inner enclosure, as shown in FIG. 2.

Figure 2:
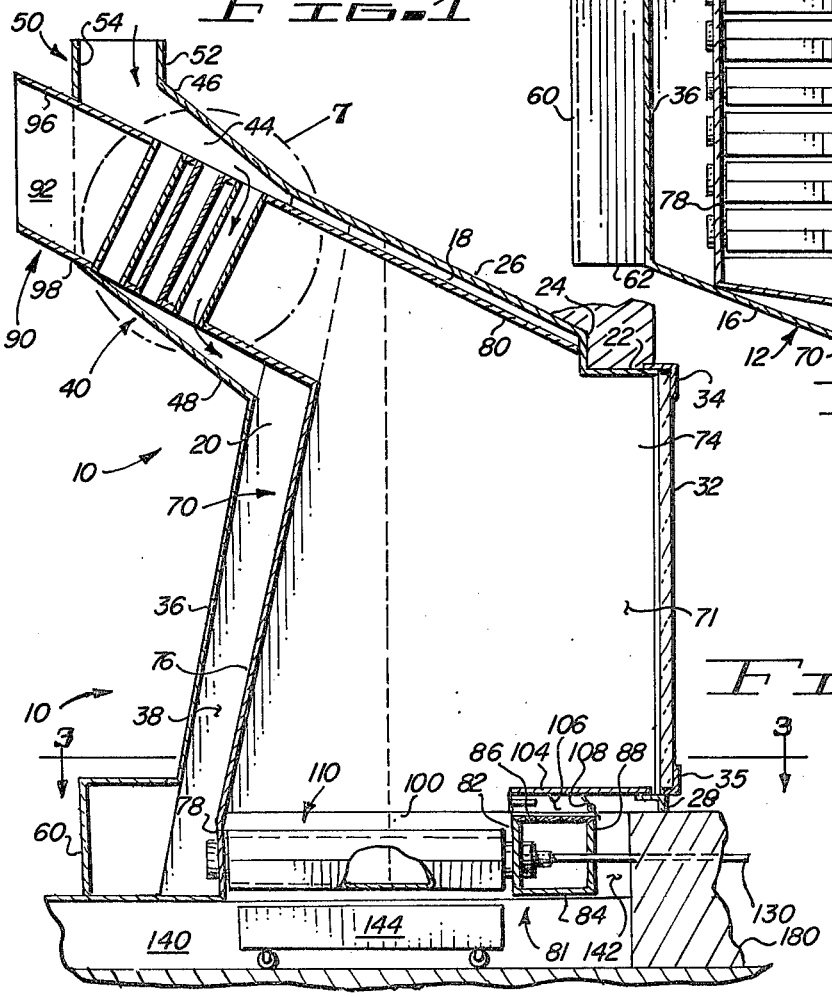
FIG. 2 is a view in partial section of the apparatus of FIG. 1 taken generally along line 2—2 of FIG. 1.

FIG. 2 is a view in partial section of the apparatus of FIG. 1 taken generally along the line 2—2 of FIG. 1. It comprises a side view of the fireplace apparatus of FIG. 1, showing the fireplace apparatus 10 which includes the outer enclosure 12 and an inner enclosure 70. Certain portions of the inner and outer enclosures are common, such as the glass front 32 which is movable within a pair of glass guides 34 and 35. The glass guides comprise angle irons which serve as a guide and a support for the glass front at the top and bottom of the glass. The guide 34 is secured directly to the top front shelf 22 which is common to both the outer enclosure 12 and the inner enclosure 70.

The top vertical panel 24 extends upwardly substantially vertically from the top front shelf 22 remote from the molding 34. The top 26 of the outer enclosure 12 is secured to the upper portion of the vertical panel 24 and extends rearwardly and upwarldy from the juncture of the two panels.

The bottom guide 35 is secured to the cross support 28, which comprises an angle iron extending the full width of the apparatus. As shown in cross section in FIG. 2, the angle iron members 28 and 35 are secured together with a slight offset to their adjacent webs.

In FIG. 1 the left front and rear sides 14 and 16 are shown, and their mating or matching sides are shown in FIG. 2. The right sides of the outer enclosure 12 includes a right front side 18 and a right rear side 20. The top panel 26 is secured to the upper portion of the right sides 18 and 20, as well as the left sides 14 and 16, as shown in FIG. 1. The rear left and right sides converge towards each other and are secured to a back 36. The back 36 is generally flat and it slopes downwardly and rearwardly from the upper duct 40 to the lower duct 60.

The upper duct 40 includes a top panel 46 and a bottom panel 48 secured to a pair of side panels, including the left side panel 42 shown in FIG. 1, and a right side panel 44 shown in FIG. 2. The top panel 46 is secured to the top panel 26 of the outer enclosure 12, while the bottom panel 48 is secured to the back 36 of the outer enclosure 12.

The top duct 50 extends substantially vertically upwardly from the upper duct 40. The top duct 50 is actually a vertically extending top portion of the upper duct 40. The top duct 50 includes a front panel 52 and a rear panel 54, both of which are secured to upwardly extending portions of the left and right sides 42 and 44 of the outer duct 40. The upper duct 50 preferably connects with other appropriate ducting in the home or other structure in which the fireplace apparatus 10 is located. In FIG. 2, it is shown that the top duct 50 is disposed substantially vertically above the lower duct work in the house to provide for the appropriate return air and distribution of heated air. Preferably, a blower may be located in the duct work to provide an appropriate forced air circulation system.

Within the outer enclosure or air jacket 12 is an inner enclosure 70. The inner enclosure 70 includes a pair of sides, including a right side 74, an upper inclined back panel 76, and a rear support plate 78 which comprises a lower vertical back member which extends vertically downwardly from the lower portion of the upper incline back 76. A top panel 80 extends upwardly and rearwardly generally parallel to the top panel 26 of the outer enclosure 12 from the vop vertical panel 24. Within the lower portion of enclosure 70 is a firebox chamber 71. Combustion takes place in the firebox.

A combustion gas flue 90 extends through the upper duct 40 to conduct the combustion gases from within the inner enclosure outwardly to a chimney. The combustion gas flue 90 is secured to the upper inclined back panel 76 and is generally square in configuration. The flue 90 includes a pair of sides, including a right side 92 shown in FIG. 2, and a left side 94, shown in FIG. 1. The sides 92 and 94 are generally parallel to each other. The combustion gas flue also includes a top 96, shown in both FIGS. 1 and 2, and a bottom 98. A plurality of heat exchangers are secured to the top and bottom panels 96 and 98 of the combustion gas flue 90 to provide for the flow of heated air through the combustion gas flue within the upper duct 40. The heat exchangers are shown in detail in FIG. 7.

The upper duct 40 and the inner combustion gas flue 90 are secured together at the back 54 of the top duct 50. That is, the back 54 of the top duct extends downwardly to join with the bottom panel 48 of the upper duct 40 and the combustion flue 90 extends through the back panel 54. Appropriate sealing is accomplished between the combustion flue and the back panel to prevent the escape of air and to retain and maintain the appropriate air flow through the apparatus.

With respect to FIG. 2, the preferable air flow is from the upper portion of the apparatus to the lower portion. That is, the return air to be heated in the fireplace furnace apparatus goes into the top duct 50, down around and through the combustion flue 90, and through a chamber 38 between the back wall 36 of the outer enclosure and the back wall 76 of the inner enclosure of the lower duct 60 from whence the heated air is distributed through an appropriate duct or conduit system throughout the house or structure in which the apparatus is disposed. As the return air extends from the upper duct to the lower duct, it picks up heat from the firebox 71 within the inner enclosure. The air flow through and around the combustion gas flue is also heated by the combustion gases as they flow through the combustion flue and are vented outwardly and upwardly through a chimney. Similarly, the air flow about the inner enclosure provides for the exchange or gain of heat by the circulated heated air for distribution throughout the structure in which the apparatus is located. The inner enclosure is virtually surrounded by the outer enclosure and the air circulates about the inner enclosure, or between the inner enclosure and the outer enclosure, and accordingly is heated in the space between the inner enclosure and the outer enclosure.

At the bottom of the inner enclosure 70 are a plurality of grates 110 on which the fuel is disposed for burning. The grates are aligned in parallel configuration from one side of the apparatus to the opposite side. The grates are supported by the rear support plate 78 at the back of the inner enclosure and by a front support plate 82 which is disposed substantially parallel to the rear support plate 78. The configuration of the grates 110 is generally rectangular in cross section, and elongated to extend between the front support plate 82 and the rear support plate 78. At the support plates, the elongated rectangularly configured grates are secured to a cylindrical portion which extends through the respective support plates. The cylindrical portions of the grates and the grates themselves are hollow to provide for the flow of air therethrough, as described below in conjunction with FIGS. 4, 5, and 6.

The front support plate 82 comprises the back panel of a laterally extending duct 81 for the heated air which flows through the grates to the space or chamber 38 at the rear of the apparatus between the respective rear panels 76 and 36 of the inner and outer enclosures 70 and 40, respectively. The duct 81 is defined by the rear panel 82, which is the front support plate for the grates 110, the bottom panel 84, a top panel 86, and a front panel 88. The duct is preferably rectangular in configuration and extends from one side of the inner enclosure to the other side to communicate directly with each of the grates and also to support the grates at their forward portions. The front panel 88 of the duct 81 includes an aperture which extends through the panel to allow for the insertion therethrough of a handle which is used, and will be explained in detail below in conjunction with FIGS. 4, 5, and 6, for rotating the grates. Alternatively, the grates which are secured together for movement from a single point, may include a tab which extends above the grates and which may be moved from within the fire box of the inner enclosure 70. The tab thus comprises a lever which may be manually actuated from within the fire box 71 within the inner enclosure. Under some circumstances, or some installations, the tab may be preferable for moving of the grates, and under other circumstances or installations, the rotatable bar may be preferable for moving the grates.

Extending from the grates to the adjacent walls of the inner enclosure are a pair of fillets, of which a fillet 100 is shown in FIG. 2. The fillet 100 thus extends from the right side wall 74 of the inner enclosure to the nearest adjacent grate. As indicated in FIG. 2, the fillet 100 extends downwardly from the wall 74 slightly above the top of the grates to about the middle of the grates. This is shown in more detail in FIG. 4. The fillet is secured to the wall 74 and is cantilevered outwardly and downwardly from the wall 74 to about the midpoint of the grates. The purpose of the fillet is to restrict or control the airflow within the lower portion of the inner enclosure.

Extending rearwardly from the cross member 28 is a floor plate 104. The floor plate is disposed above the upper panel 86 of the duct 81. Between the upper panel 86 of the duct 81 and the floor plate 104 is a channel or air passage 106. The flow of air through the channel 106 is controlled by an air valve 108.

Beneath the apparatus is a passageway 140 in which is disposed an ash cart 144. The passageway 140 defines a conduit for the entry of combustion air and for the movement of the ash cart 144. That is, when a fire is made within the fire box 71, defined by the lower portion of the inner enclosure 70, fuel is disposed on the grates 110. The ash cart 144 is located beneath the grates 110 for cleaning purposes. The ash cart 144 is preferably removed from outside the structure or home in which the fireplace furnace apparatus 10 is disposed. Accordingly, the passageway 140 communicates directly with the outside of the structure and appropriate provisions are made for the combustion air to enter the fireplace apparatus from outside the house through the passageway 140. In this manner, there are two separate air systems, one for the combustion air and one for the heated air. Combustion air extends through the passageway 140, and up through a vertically extending passageway 142 defined between the rear of a hearth 180 and the forward or front panel 88 of the duct 81 and into the passageway or channel 106. The channel 106 communicates directly with the fire box 71 within the inner enclosure 70 at the top portion of the grates 110. The air thus flowing from the passageway 140 and past the air valve 180 into the channel 106 is directed into the inner enclosure above the grates 110 and accordingly directly at the fuel disposed on the grates.

Figure 4:
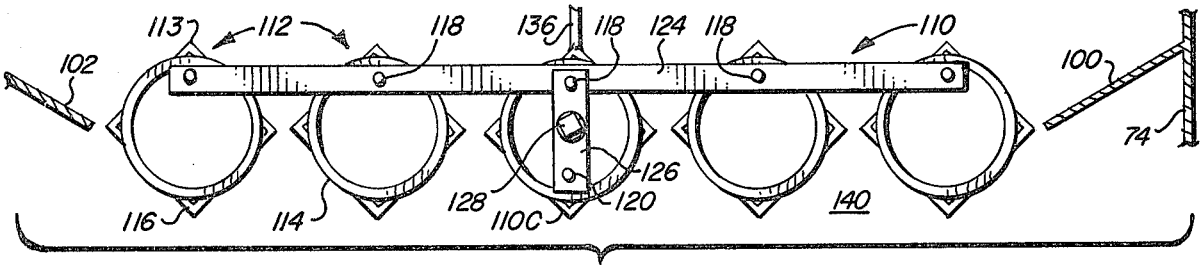
FIG. 4 is a front view of the grates disposed in the lower portion of the fireplace apparatus of the present invention.

The amount of air flowing into the inner enclosure is controlled by movement of the air valve 108. Maximum air flow is accomplished when the air valve is moved to a horizontal position which opens the channel 106 directly to the passageways 140 and 142, and minimum air flow is accomplished when the air valve 108 is moved to a nearly vertical position which substantially closes the passageway 106. There will be some movement of air vertically from the passageway 130 to the grates 110. However, the fillets, such as fillet 100, reduce the flow of air upwardly and the close proximity of the grates with respect to each other, as shown in FIG. 4, minimizes the vertical flow of air upwardly from the passageway 130.

Figure 3:
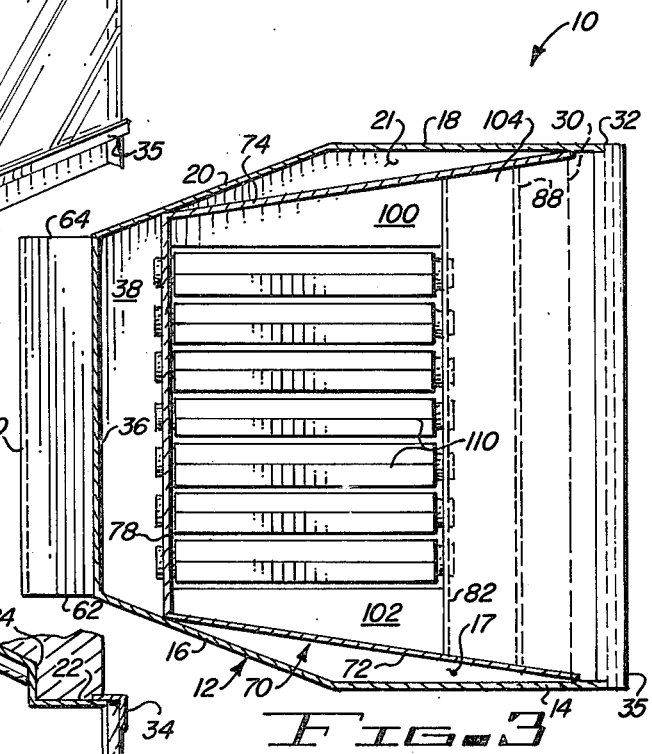
FIG. 3 is a view in partial section of a portion of the apparatus of FIG. 2 taken generally along line 3—3 of FIG. 2.

FIG. 3 is a view in partial section of the apparatus of the present invention taken generally along line 3—3 of FIG. 2. It comprises a vertical plan view in partial section of the lower portion of the fireplace furnace apparatus 10, looking downwardly toward the grates 100.

The fireplace furnace apparatus 10 as viewed in FIG. 3 clearly discloses the two separate enclosures, the outer enclosure 12 and the inner enclosure 70. At the front of the fireplace furnace apparatus, and shown in phantom, is the glass panel 32, held within glass guide or frame 35. The glass 32 comprises a glass door movable or slidable to allow access to the interior of the inner enclosure for purposes of making a fire, adding fuel, cleaning the apparatus, and the like.

Rearwardly of the glass front 32 and its guide 34 is the plate 104 which extends rearwardly to the plurality of grates 110. Several lines are shown in phantom beneath the plate 104, such as the forward panel 88 of the duct 81 (see FIG. 2) and the front support plate 82 of the grates 110, which comprise the rear panel of the duct 81. On both sides of the grates 110 are shown the pair of fillets 100 and 102. The fillets extend from the adjacent grate outwardly to the respective right side 74 and left side 72 of the inner enclosure 70. The fillets further extend from the rear support plate 78, which comprises the lower vertical back of the inner enclosure 70, to the front support plate 82 of the grates 110. The purpose of the fillets has been discussed above.

Spaced apart from the inner enclosure 70 is the outer jacket or enclosure 12, which includes a pair of side panels on both the right side and the left side. The left side of the outer enclosure includes a left front side 14 and the left rear side 16, while the right side of the outer enclosure includes right front side 18 and right rear side 20. The sides 14 and 16 are connected together, as are the sides 18 and 20, with a relatively large obtuse angle disposed therebetween. The left and right front side walls or panels 14 and 18 are secured to the front of the apparatus adjacent the glass guide 34, as shown in detail in FIGS. 10 and 11, and the respective top and bottom portions of the outer enclosure, as illustrated in FIGS. 1, 2, and 3.

The back or rear side of the outer enclosure includes the generally vertically extending wall 36 which is secured to both the left and right rear side panels 16 and 20. The lower duct 60 is in turn secured to the rear panel 36. The lower duct 60 is open at its left and right ends, which define a pair of apertures or open ends 62 and 64. Preferably, the lower duct 62, at its open ends, connects with other ducting for providing a conduit for the heated air away from the outer enclosure to be circulated throughout the structure in which the apparatus is installed.

The overall configuration of the fireplace furnace apparatus 10 may be seen from the plan view of FIG. 3. The inner enclosure 70 is generally trapezoidal in configuration, with the front portion of the apparatus, defined by guide 34 and the glass panel 32, and the rear of the inner enclosure, defined either by the lower rear support plate 78, seen in FIG. 3, or the upper back panel 76, shown in FIG. 2, parallel to each other. While the back panel 76 extends forwardly, it is generally parallel, on any line taken horizontally, to the front of the apparatus. The sides 72 and 74 are not parellel, but rather taper inwardly from the front of the apparatus toward the back of the apparatus.

The outer enclosure 12 extends generally away from the left and right side walls or panels of the inner enclosure rearwardly from the front of the apparatus, to the obtuse angle which joins the front and rear side panels of the outer enclosure. The rear side panels of the enclosure then extend rearwardly and inwardly to the back or rear wall 36 of the apparatus. As indicated in FIG. 3, the junctures of the side panels or walls of the inner enclosure with the back or rear wall are close to the juncture of the side panels of the inner enclosure with the back or rear wall panel of the outer enclosure. However, there may be clearance between the respective inner and outer enclosures, and such spacing is preferable. Between the inner and outer enclosures is space defining three separate chambers to the rear and on both sides of the inner enclosure and a fourth chamber or space is defined between the top or upper panel of the inner enclosure and the outer enclosure, as best seen in FIG. 2.

On the left side is a chamber 17 defined by the walls 14 and 16 of the outer enclosure or jacket 12 and the inner enclosure wall 72. Another chamber 21 is defined by the walls 18 and 20 of the jacket 12 and the wall 74 of the inner enclosure 70. The chamber 38 is shown between the walls 36 and 76, 78 of the outer and inner enclosures, respectively. (See also FIG. 2.) A fifth chamber may be defined as comprising the area within the hollow grates 110. The grates communicate with chamber 38 at the rear of the apparatus and, though the duct 81 (see FIG. 2), with the chambers 17 and 21, as will be explained in detail below in conjunction with FIGS. 4–6 and 10–12.

The space or chambers are of course used for the circulation of air to be heated from the combustion taking place within the inner enclosure. The heat generated by the combustion radiates outwardly from the top and sides of the inner enclosure where the heat is picked up by the air circulating between the walls or panels of the inner and outer enclosures. The concept of the circulation of the air with respect to the inner and outer enclosures may be seen by referring to FIGS. 1, 2, and 3. In addition to the heat radiated outwardly from the walls or wall panels of the inner enclosure, a substantial amount of heat extends upwardly and out of the combustion gas flue 90, as shown in FIGS. 1 and 2. The heat thus flowing outwardly in the combustion gases is absorbed by the air flowing through the outer duct 40 of the outer enclosure, a portion of which also flows through the heat exchangers which extend through the combustion gas flue to provide for the communication of the circulated heated air flow through the combustion gas flue within the upper duct 40. The configuration of the apparatus provides for the maximum transfer of heat from the air and combustion gases from within the inner enclosure to the circulating air outside the inner enclosure and within the outer enclosure.

The heat exchange is further enhanced by the flow of circulating air at the lower portion of the apparatus through the grates. Thus the inner enclosure and the outer enclosure are arranged in such a manner that the circulating air circulates above, beneath, and even through the air and gases within the inner enclosure and yet the two air flows are independent of each other to keep separate the combustion gases and the circulated, heated air.

FIG. 4 is a front view of the grates 110 disposed in a lower portion of the fireplace apparatus of the present invention. The front support plate 82 is not shown in FIG. 4, but rather has been removed for clarity and to illustrate the construction of the grates. It will be understood that, as shown in FIGS. 2 and 3, the grates are supported both in front and in back by a pair of substantially parallel support plates.

The grates 110 are disposed within the inner enclosure, (see FIGS. 2 and 3) above the passageway 140 and intermediate the sides of the inner enclosure (see FIG. 3). The grates are disposed in substantial parallel alignment with respect to each other, but they are not parallel to the sides of the inner enclosure because, as shown in FIG. 3, the sides 72 and 74 are not parallel to each other. To substantially seal off the passageway 140 from the combustion chamber within the inner enclosure above the grates, a pair of fillets 100 and 102 are secured to the sides of the inner enclosure. Fillet 100 is secured to the side 74 and the fillet extends from the side downwardly and toward the nearest or most adjacent grate and to about the midpoint of the grate. Fillet 102 is secured to the adjacent left side wall or panel 72 (see FIG. 3) in an orientation substantially identical to that of fillet 100.

There are preferably an odd number of grates 110 disposed within the inner enclosure. As indicated in FIG. 3, seven grates are used but only five are shown in FIG. 4. The grates 100 comprise a generally square, elongated hollow tube or member 112. Secured, as by welding, to each end of the elongated members 112 is a circular cylindrical connector 114. The cylindrical connector 114 is hollow and it communicates directly with the interior of the elongated member 112 to which it is secured. The sides of the elongated tubular members 112 comprise a rectangle and the juncture of the rectangles define edges 113 which extend the axial length of each side and accordingly of each member 112. In actual fabrication, each square cylindrical member 112 may be facricated from square tubing.

The cylindrical connections are dimensioned so as to overlap the walls of the square tubing, thus providing a sealing of the corners of the square tubing at the connectors by welds 116 which accordingly fill in the gaps between the walls of the square and the cylindrical tubings. The connectors are welded to each end of square tubing to provide bearing and support surfaces for each grate.

The grates are formed of the square tubular configuration to maximize the external area of the grates. As is understood, a square configuration provides the maximum exterior surface area of a structure, while a cylinder provides the minimum external surface area of a structure for a given diameter or side to side distance. Accordingly, a square or other noncylindrical cross-sectional configuration is preferred for maximizing the surface area of the grates. This maximum surface area in turn enhances the transfer of heat from within the fire box or combustion chamber to the heated air circulating through each of the grates, as explained above and as shown in conjunction with FIGS. 2 and 3.

The cylindrical connectors 114 extend through matching or mating apertures in the support plates 78 and 82 as shown in FIGS. 2 and 3. The cylindrical connectors allow the grates to rotate for cleaning purposes, which allow the ashes and other residue from combustion which takes place on top of the grates to fall between the grates as the grates are rotated from a position shown in FIG. 4, which is the working position, to a position substantially forty-five degrees from that shown in FIG. 4, in which the sides of the square tubular members are oriented substantially parallel and perpendicular, with respect to each adjacent side, to the ground. The grates as shown in FIG. 4 in working position have minimum clearance between adjacent grates. In actuality, the spacing between adjacent grates shown in FIG. 4 is exaggerated, and the same is true with respect to the fillets and 100 and 102. That is, the junctures 113 of adjacent grates are nearly touching each other. There is only a minimum working clearance between the junctures sufficient to allow the grates to rotate. The forty-five degree rotation of the grates for dumping provides maximum clearance between the grates which accordingly permits the residue to fall between the grates and into the ash cart 144 (see FIG. 2) beneath the grates.

Rotation of the grates is accomplished by means of a connector bar 124 secured to each grate and an actuator bar 126 secured to the central grate, designated in FIG. 4, by reference numeral 110c. Since rotating of the grates is best accomplished through symmetry, the actuator bar 126 is secured to the central grate. Hence an odd number of grates is preferred.

A pin 118 is secured to each cylindrical connector 114, and extends forwardly to the cylindrical connector. The connector bar 124 in turn includes a plurality of apertures which receive the pins 118. The pins 118 are appropriately secured for rotation within the mating apertures in the connector bar 124. As shown in FIG. 4, the pins 118 are secured to each cylindrical connector adjacent the top most or uppermost juncture 113 of each square member 112. The grate 110c includes a second pin 120 also connected to the cylindrical connector 114 and extending outwardly therefrom, substantially parallel to the pin 118. The pins 118 and 120 are diametrically disposed with respect to each other on grate 110c. The actuator bar 126 is in turn secured to the pins 118 and 120 through matching or mating apertures which receive the pins.

A socket 128 is secured centrally with respect to the grate 110c and extends along the longitudinal axis of the grate 110c outwardly from the bar 126. The socket in turn receives the end of a lever to which rotary force is applied to rotate the actuator bar 26 and accordingly to rotate the connector bar and the grates secured to the connector bar.

As shown in FIG. 2, mating and aligned apertures must extend through the lower portion of the furnace apparatus, and outwardly through the hearth 180 to allow the actuator rod to rotate in order to rotate the grates. If such arrangement is impractical, a pin 136 may be secured to the center grate 110c from its top edge 113. If the pin 136 is used, the actuator bar 126 with its socket 128 may be omitted, but the connector bar 124 is still required.

Figure 5:
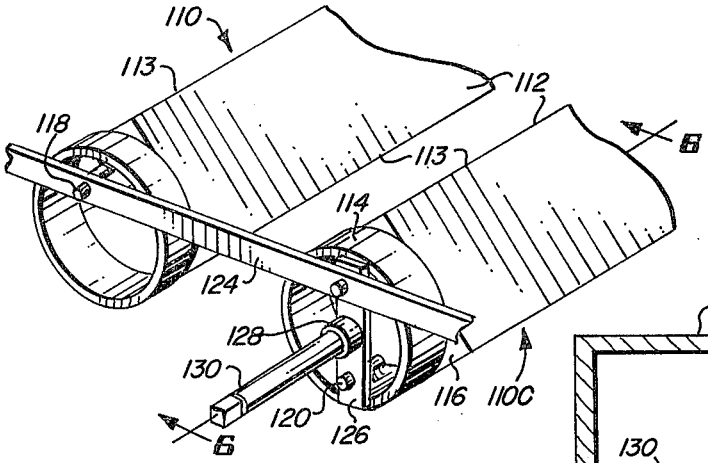
FIG. 5 is a perspective view of a portion of the apparatus of FIG. 4.

FIG. 5 is a perspective view of a portion of the apparatus of FIG. 4, comprising a view of a pair of adjacent tubular grates 110. The grates are shown in the same orientation with respect to the connector bar 124 as shown in FIG. 4. That is, the grates are in working order or working position to receive fuel, such as logs, on the top of the grates for burning. The grates 110 comprise square tubular members with sides 112 disposed at right angles to each other. In the working position, the sides 110 are shown with edges 113 of the adjacent sides being disposed, as in FIG. 4, in the 12 o'clock, 3 o'clock, 6 o'clock, and 9 o'clock positions. In this orientation, there is minimum clearance between adjacent grates. Accordingly, there is minimum vertical air flow between the grates from beneath the grates to above the grates, and the combustion air is directed horizontally above the grates, as illustrated in FIG. 2. However, with the particular square configuration of the tubular grates 112, there is horizontal air flow between adjacent sides to provide a flow of air beneath the fuel on the grates, as well as on top of the fuel through passageway 106. This may best be seen in conjunction with FIGS. 4 and 5. The connector bar 124 is shown secured to pins 118 which extend outwardly from the cylindrical connectors 114 secured to the end walls 116 of the grates. The grates 110 are hollow and accordingly provide for the flow of air through the grates and through the cylindrical portions 114 regardless of the orientation of the grates.

Figure 6:
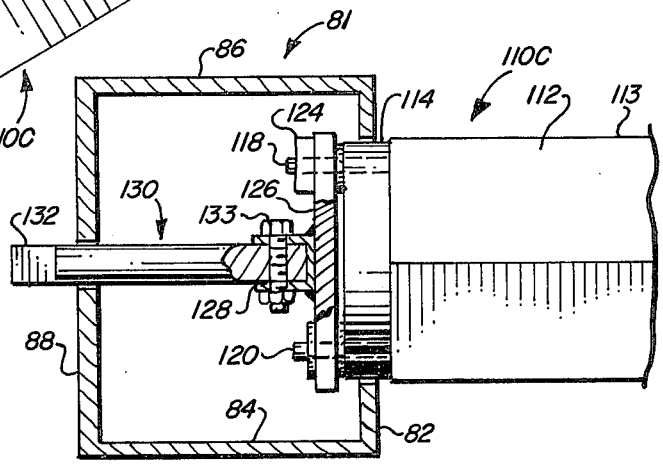
FIG. 6 is a view in partial section of the apparatus of FIG. 5 taken generally along line 6—6 of FIG. 5.

The actuator bar 126 is secured to the central or center most grate 110c, for ease of rotation of the grates, as discussed above. The actuator bar 126 is secured to the pins 118 and 120 which in turn are secured to the cylindrical portion 114 of the grate 110c. Socket 128 is secured to the center of the bar 126 and extends outwardly from the bar to receive an end portion of a turning rod 130 which is pinned to the socket 128, as shown in FIG. 6. The rod 130, or an extension thereof, extends outwardly from the furnace, as shown in FIG. 2, and is used for turning the grates, as discussed above.

FIG. 6 is a view in partial section of the apparatus of FIG. 5, taken generally along line 6—6 of FIG. 5. FIG. 6 illustrates the actuation of the grates by means of the rod 130 which extends through the duct 81 (see also FIG. 2). The grate 110c, the center grate, is shown from the side, and the connector bar 124 and the actuator bar 126 are shown secured to the grate 110c by means of the pins 118 and 120. The pins 118 and 120 are secured to the cylindrical connector position 114 which is in turn secured to the grate 110c.

The grate 110c is in its operative position, with the top edge 113 disposed at the top of the grate, and extending upwardly. This is the same position or orientation of the grate as illustrated in FIGS. 4 and 5. The cylindrical connector portion 114 extends from one end of the grate 110c into the duct 81. The duct 81 includes an aperture in wall panel 82 in which the cylindrical connector 114 extends and in which the cylindrical portion rotates with the grate in response to rotation of the rod 130. Secured, as by welding, to the inner periphery of the short cylinder 114 are the pins 118 and 120. The pins are diametrically opposed to each other, with pin 118 in the 12 o'clock position, or upwardly with respect to the top juncture 113 of the sides 112, and pin 120 adjacent the lower juncture of the sides at the 6 o'clock position. The bar 124 is inserted onto the pin 118 by means of an appropriate aperture in the connector bar 124 and the aperture is of sufficient size to allow the pin 118 to rotate freely with respect to the bar 124. The actuator bar 126 is disposed between the cylindrical connector 114 and the connector bar 124.

The actuator bar 126 includes a pair of apertures through which the pins 118 and 120 extend. Appropriate fastening means are used to secure the bars to the pins 118 and 120. Such fastening means are well known, and may include washers with cotter pins extending through passageways in the bar, end caps, which fit over the ends of the pins, or any other appropriate type apparatus.

The duct 81 includes a front support plate 82 for the grates, and which comprises the back or rear panel of the duct. The plate 82 includes a plurality of apertures through which the circular cylindrical connector portions 114 of the grates extend, as illustrated in FIG. 2. The duct 81 also includes a bottom panel 84, a top panel 86, and a front or forward panel 88. The front panel 88 includes a central aperture through which the rod 130, or an extension thereof, extends. The rod 130 preferably includes a square end 132 which matingly receives an appropriate instrument used to rotate the rod 130 which in turn results in the rotation or turning of the grates 110, as discussed above. The rod 130 may terminate with its end 132 within the duct 81. If so, an extension rod is needed to rotate the grates by extending through the hearth (see FIG. 2) and through an aperture in the wall panel 88.

The rod 130 extends into the socket 128, which is secured to the actuator bar 126. As shown in FIG. 6, the socket 128 includes a pair of apertures and the rod 130 includes a diametrically extending passageway or hole which is aligned with the holes or apertures in the socket 128. An appropriate fastening means, such as a bolt or screw, extends through the socket, and the rod, and is held in place by a nut. The fastening means, or bolt and nut, are identified in FIG. 6 by the reference numeral 133. Obviously, any appropriate means may be used to removably secure the rod and the socket together.

Figure 7:
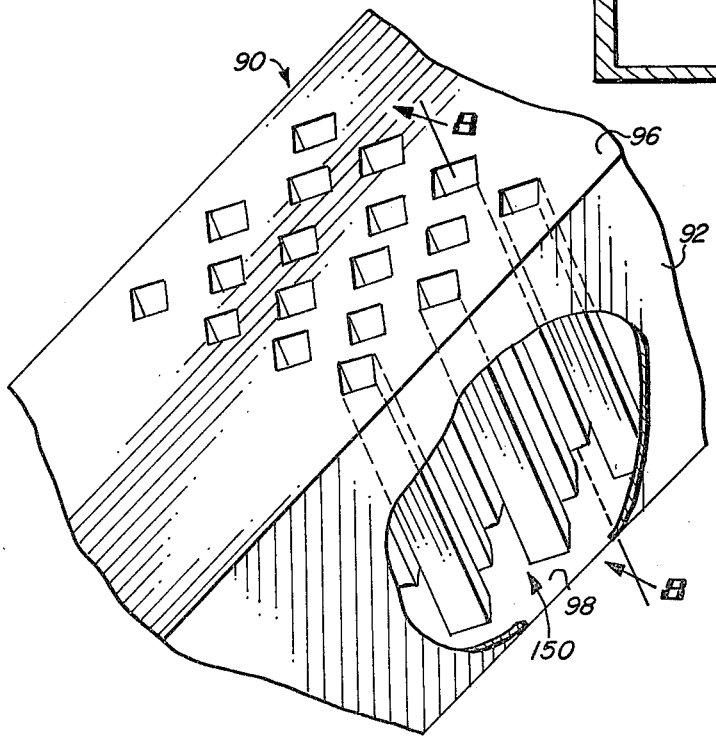
FIG. 7 is a perspective view, with a portion cut away, of a portion of the apparatus of FIG. 2 as taken from circle 7 of FIG. 2.

FIG. 7 is a perspective view, partially cut away, of a portion of the apparatus of FIG. 2, taken generally from the circle 7 of FIG. 2. It comprises a perspective view of a portion of the combustion gas flue 90 showing the plurality of miniature square ducts 150 which extend through the combustion flue to allow air to move through the flue and accordingly to pick up heat as the air moves through the miniature ducts. In this way a heat exchange takes place by which the combustion gases lose heat or transfer heat to the air flowing through the miniature ducts 150.

The combustion gas flue 90 is a generally square, in cross section, duct which includes, as illustrated in FIG. 7, a right side panel 92, a top panel 96, and a bottom panel 98. Obviously, there is a left side panel to the combustion flue duct also, but it is not shown in FIG. 7.

The plurality of mini ducts 150 extends through and are secured to the top panel 96 and the bottom panel 98. That is, the mini ducts 150 extend between the top panel and the bottom panel within the combustion gas flue 90. Each mini duct 150 is of generally square, elongated, tubular configuration, similar to the grates 110, as discussed above. A square configuration is used to maximize the outer surface or skin area of each mini duct. The mini ducts are configured in rows across the combustion flue between the side panels of the combustion flue, with alternate rows of the mini ducts disposed between the mini ducts of adjacent rows. In other words, alternate rows are parallel to each other, with adjacent rows disposed between the ducts in a staggered configuration. This allows the combustion gases flowing through the combustion gas flue to have maximum contact with the surface area of the mini ducts and insuring that the combustion gases are not allowed to flow in a straight line. The combustion gases accordingly flow in a sepentine manner about and around the mini ducts disposed within the combustion gas flue. An edge or apex of each mini duct 150 is disposed directly against the air flow to enhance the flow of air through the network of mini ducts within the combustion gas flue. The mini ducts communicate directly with the upper duct 140, as shown in FIG. 2.

As may clearly be seen from FIG. 7, particularly in view of FIG. 2, there is a maximum opportunity for the exchange of heat from the combustion gases flowing through the combustion gas flue 90 to the air flowing within the upper duct 40 (see FIG. 2) and through the combustion gas flue by means of the mini ducts 150. The heated air thus flows around and through the combustion gas flue which is disposed within the upper duct 40, as shown in FIG. 2, and the air also flows through the combustion gas flue by means of the mini ducts 150. The mini ducts 150 are sealingly secured to the combustion gas flue to prevent contamination of the heated air from the combustion gases.

Figure 8:
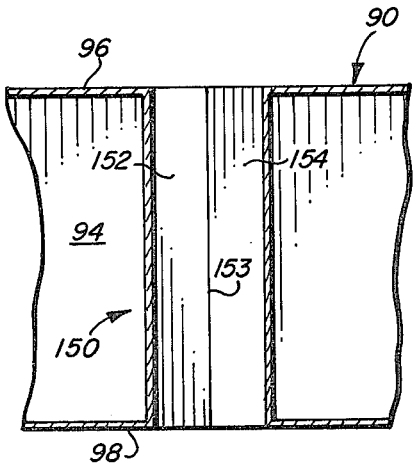
FIG. 8 is a view in partial section of a portion of the apparatus of FIG. 7 taken generally along line 8—8 of FIG. 7.

FIG. 8 is a view in partial section of the apparatus of FIG. 7 taken generally along line 8—8 of FIG. 7. It comprises a view in partial section through a mini duct 150 and through the combustion gas flue 90.

The combustion gas flue 90, as shown in FIG. 8, includes the top panel 96, the bottom panel 98, and a left side panel 94, which was referred to previously in conjunction with FIG. 7, but is not shown in FIG. 7.

A mini duct 150 is shown extending between the top panel 96 and the bottom panel 98. The mini duct 150 is secured to the respective top and bottom panels, as discussed above, to prevent communication between the combustion gases flowing within the combustion gas flue 90 and the circulating heated air flowing within the upper duct 40, as shown in FIG. 2, and through the mini duct(s) disposed in the combustion gas flue 90.

Each mini duct 150 includes four rectangular sides, each of which is substantially identical to the other, to comprise an elongated tubular duct having a square cross sectional configuration. Two sides 152 and 154 are shown in FIG. 8. The sides are secured tog ther to define four apexes, or edges, of which a single edge or apex 153 is clearly shown in FIG. 8. As with the grates, the mini ducts may be square tubing.

With respect to the flow of the combustion gases through the flue or duct 90, which is generally parallel to the sides 92 and 94 and 96 and 98 of the flue 90 (see also FIG. 7), each mini duct 150 is disposed at an angle so that an edge or juncture of two adjacent sides is disposed directly against the air flow. The juncture thus comprises an edge which helps to smoothly divide the flow of the combustion gases against the side panels of the mini ducts to enhance the flow of the combustion gases through the array of mini ducts within the combustion gas flue. The sides of the mini ducts 150 are not parallel to the sides 92 and 94 of the flue or duct 90, but rather are disposed at a 45° angle to the sides 92 and 94 (see also FIG. 7). Moreover, as clearly shown in FIG. 7, the spacing between the mini ducts 150 is lesss than the width, from side juncture to side juncture across the ducts, so that each row of mini ducts overlaps the adjacent rows to insure that the combustion gases must flow in a tortuous path and accordingly must flow against the mini ducts to provide for the desired exchange of heat with respect to the combustion gases and to the heated air flowing through the mini ducts.

Figure 9:
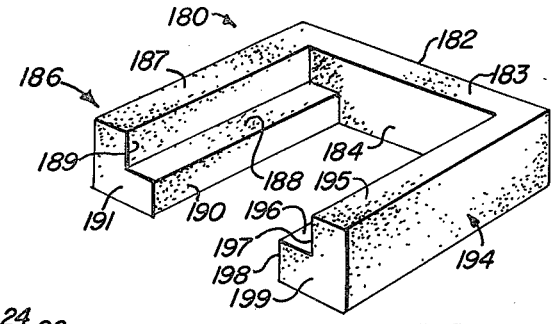
FIG. 9 is a perspective view of a base or hearth for the fireplace apparatus of the present invention.

FIG. 9 is a perspective view of hearth apparatus 180 used as a base for the fireplace apparatus of the present invention. The hearth 180 is generally of a U-shaped configuration, with a front wall 182 and a pair of sides, including right side 186 and left side 194.

The right and left sides comprise walls which extend rearwardly from the front wall 182.

The front wall includes a top surface 183, and a rear surface 184 which extends downwardly substantially perpendicular to the top surface 183. The rear surface or face 184 is generally smooth, and does not include a platform as do each of the side walls.

The right side wall 186 includes a top surface 187 which is in the same plane as the top surface 183 of the front wall 182. The right side wall 186 also includes a platform 188 which is substantially parallel to the top surface 187, but disposed part way down with respect to the overall height of the hearth. Extending upwardly from the inner portion of the platform 188 to the top surface 187 is a top inner side or face 189, and extending downwardly from the platform 188 is a lower inner side or face 190. The faces 189 and 190 are substantially parallel to each other, but offset by the width of the platform 188. A rear face 191 comprises the end wall of the right side 186.

The left side wall 194 is substantially a mirror image of the right side wall 186. It includes a top surface 195 which is in the same plane as the top surface 183 of the front wall, and accordingly also in the same plane as the top surface 187 of the right side wall 186. Parallel to the top surface 195 is a platform 196 which is substantially parallel to, and in the same plane as, the platform 188. A top or upper inner side or face 197 extends upwardly from the platform 196 to the top surface 195, and a lower inner side or face 198 extends downwardly from the platform to the bottom of the hearth. The faces 197 and 198 are also substantially parallel to each other, but offset, as are the faces 189 and 190 of the right side wall 186. A rear face 199 comprises the end wall of the left side. The rear faces or end walls 191 and 199 are substantially parallel to each other and in the same plane.

Referring also to FIG. 2, the support member 28 is disposed on the top surface 183 of the hearth, and the bottoms of the side walls of the inner and outer enclosures rest on the platforms 188 and 196 of the hearth. The rear faces 191 and 199 may rest against or within a wall of the structure in which the fireplace apparatus is disposed. The passageway 140 is defined between the lower inner sides or faces 190 and 198 of the hearth. The ash cart 144 is disposed within the passageway 140 between the side walls of the hearth. The vertically extending passageway 142 is defined by the rear side or face 184 of the front wall 182 of the hearth and the adjacent portions of the upper inner sides or faces 189 and 197 of the side walls of the hearth.

Figure 10:
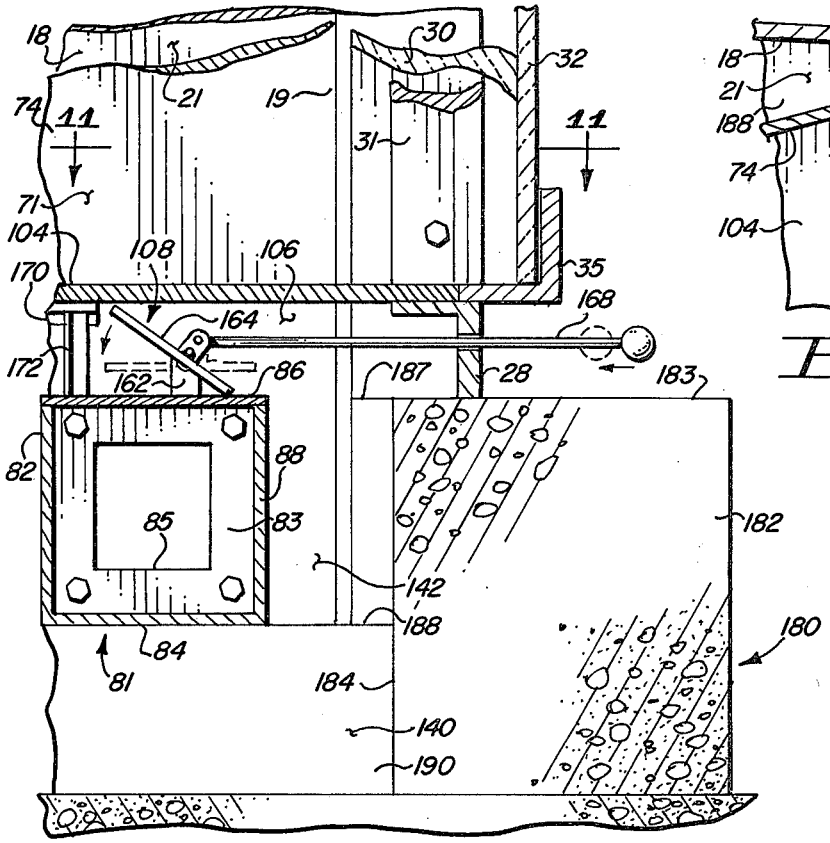
FIG. 10 is an enlarged view in partial section of a portion of the apparatus of the present invention.

FIG. 10 is an enlarged view in partial section of a portion of the apparatus of the present invention, comprising an enlarged view showing the disposition of the lower front portion of the fireplace apparatus 10 disposed on the hearth, and also showing the operation of air valve 108.

The fireplace apparatus is shown disposed on the hearth 180, with the laterally extending cross support 28 disposed on the top surface 183 of the front wall 182 of the hearth. The cross support member 28 comprises an angle iron which is secured, as by welding, to another angle iron 35 which is the guide for the glass front 32. The angle irons 28 and 35 are welded together at their horizontally extending webs, slightly offset, so that one web or arm of the support member 29 extends downwardly to rest upon the top surface 183 of the hearth, and one web or arm of the angle iron 35 extends upwardly to provide a guide for the glass 32.

Figure 12:
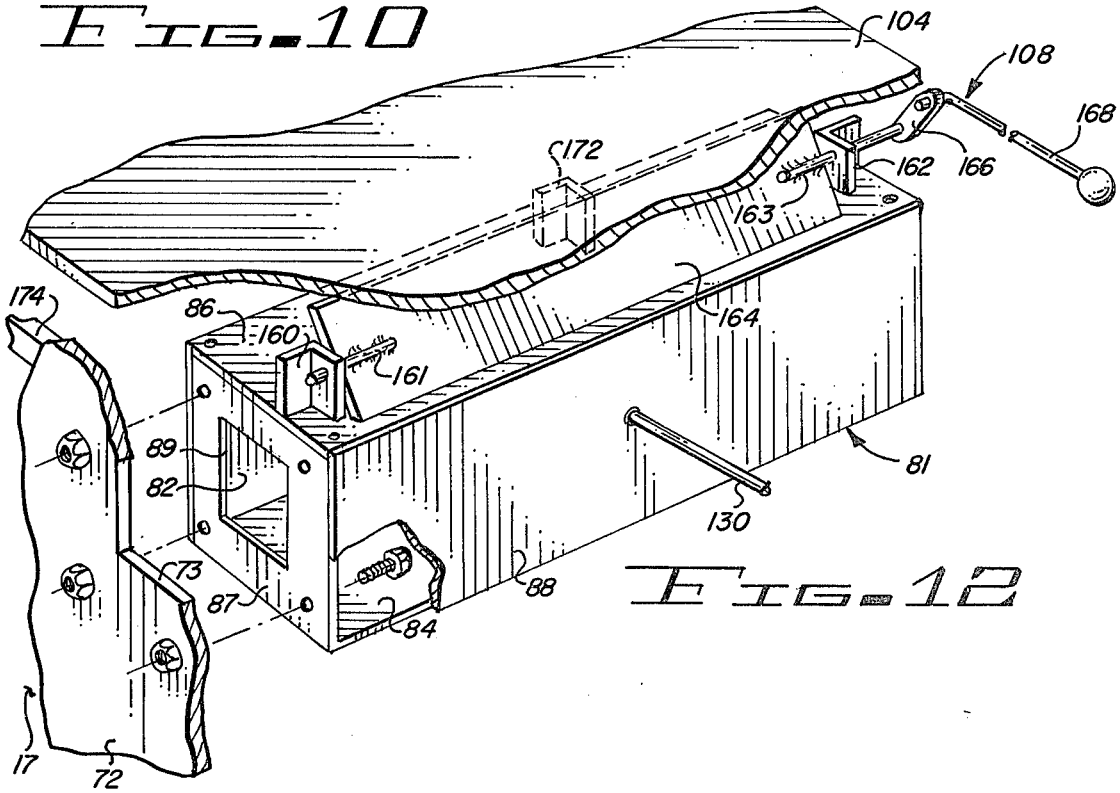
FIG. 12 is a perspective view, partially exploded and partially broken away, of a portion of the apparatus of the present invention, showing details of construction and operation.

The plate 104 is disposed at its forward end on the horizontally extending web of the support member 28 and against the horizontally extending web of the guide angle bracket 35. The plate 104 defines the top portion of the passageway 106 in which is disposed the air valve 108. The rear portion of the plate 104 is disposed on three angle iron supports, two of which are welded to the sides 70 (see FIG. 3) and 74 of the inner enclosure, and the third support is disposed on the top panel 86. Two of the supports, support 170 and support 172, are shown in FIG. 10. The third support, support 174, is shown in FIG. 12. The support 170 comprises a length of angle iron welded to the inner wall 74 in a horizontal orientation. The plate 104 is disposed on the horizontally extending web of the angle iron. The support 172 is disposed in a vertical orientation on the top plate 86, preferably centered between the walls 72 and 74.

The side walls 18 and 74 of the outer and inner enclosures, respectively, are secured together rearwardly of the glass 32. At their juncture, they are secured together preferably by welding. The chamber 21 between the side walls, as indicated in FIG. 3, widens to a maximum and then diminishes to a minimum adjacent the rear or back end of the inner enclosure. Heated air flows through the space between the walls for circulation, ultimately, throughout the structure in which the apparatus is disclosed. The juncture of the inner side wall 74 with the outer side wall 18 is denoted by reference numeral 19, and the vertically extending juncture or weld 19 is spaced apart rearwardly from the glass front 32. Between the glass 32 and the weld or juncture 19 is a packing strip 30. The packing strip 30 is held in place by a strip 31, which is a vertically extending steel strap. The strap 31 is appropriately secured to the outer wall 18, as by a bolt, or other well known type fastener. The packing 30 extends to the glass 32 and comprises a seal between the glass and the fireplace apparatus. Appropriate material, such as fiberglass, may be used for the packing. The forward or leading edge of the packing 30 disposed against the glass 31 acts as a wiper against the glass as the glass moves in its guides to prevent the air from being drawn from the room in which the apparatus is located for combustion. As a side benefit, smoke is also prevented from entering the room.

The outer wall 18 and the inner wall 74 are disposed on the platform 188 of the hearth 180. The bottom panel 84 of the duct 81 also rests on the platform 188, although the duct is secured to the inner wall 74. The passageway 140 is shown extending beneath the fireplace apparatus and within the hearth. Above the passageway 140, and adjacent the rear side or face 184 of the front wall 182 of the hearth is the passageway 142 which extends between the lower passageway 140 and the passageway 106 in which is disposed the air valve 108. The air valve 108 controls the flow of air from the passageways 140 and 142 into the fireplace apparatus and accordingly controls the burning or combustion within the apparatus.

The duct 81 is secured to the side wall 74 of the inner enclosure by an end panel 83 which is appropriately secured to the front support plate 82, which comprises a rear panel 88. The end panel 83 has a square or rectangular aperture 85 extending through the panel to allow for the flow of heated air from within the duct 81 to the space or chamber 21 between the wall 74 and the wall 18. A mating or matching aperture extends through the inner wall 74 to allow for the flow of air directly from the duct 81 into the chamber 21. As indicated, the duct 81 is secured to the wall 74 by appropriate means, such as a plurality of bolts, the leads of which are shown in FIG. 10 extending through the end panel 83 and into the wall 74.

The air valve 108 is shown secured to the top panel 86 of the duct 81. The air valve includes a bracket 162 disposed on, and secured to, the top panel 86 of the duct. A vane or plate 164 is appropriately secured to the bracket 162 and the vane or plate is movable in the passageway 106 by means of a rod 168 which is secured to the vane 164 by appropriate mechanical linkage. The rod 168 extends outwardly of the apparatus through a small hole or aperture in the vertically extending web of the support member 28. Axial movement of the rod 168, as shown in phantom in FIG. 10, results in movement of the vane 164 in the passageway 106 to control the flow of air. In the position shown in FIG. 10, the vane 164 substantially blocks the flow of air through the passage 106, but, when moved to the position shown in phantom, by an axially inwardly movement of the rod 168, the vane 164 is generally parallel with the plate 104 and the top panel 86 of the duct 81 and the flow of air through the passageway 106 is then substantially unrestricted.

Also disposed on the top of the panel 86 is the support bracket 172, as discussed above. The bracket or support 172 comprises a length of angle iron disposed vertically on the top panel 86 to support the plate 104 intermediate the sides of the fire box. The plate 104 is thus supported by support member 28 all along its forward edge and at its two side edges by support brackets 170 and 174, and at the center of its rear edge by vertical support bracket 172. The vane 164 easily clears the bracket 172 in its movement. The bracket 172 is relatively small compared to the overall area of the passageway 106 so as not to significantly impede the flow of air in the passageway.

Figure 11:
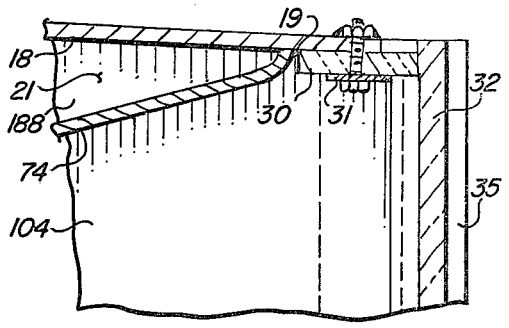
FIG. 11 is an enlarged detail view in partial section of the apparatus of FIG. 10 taken generally along line 11—11 of FIG. 10.

FIG. 11 is an enlarged detailed view in partial section of the apparatus of FIG. 10 taken generally along line 11—11 of FIG. 10. The view illustrates the corner of the fireplace apparatus where the right side panel 18 of the outer enclosure or jacket joins the right side wall or panel 74 of the inner enclosure. The joining of the two side wall panels is preferably accomplished by means of a welded bead 19 which defines the juncture of the two panels. Between the two panels is the chamber 21 through which flows the heated air. As the air flows in the chamber 21, it is heated from within the apparatus through the side wall panel 74 of the inner enclosure.

Adjacent the juncture 19 of the side panels 18 and 74, and secured to the portion of the side wall panel 18 forwardly of the juncture 19 with the side wall 74, is the packing 30. The packing 30 is appropriately secured to, and held against, the wall 18 by means of the strap 31. Appropriate fasteners, such as a plurality of bolts, are used to secure the strap, the packing, and the side wall 18 together.

The packing 30 is in turn disposed against the inner side of the glass panel 32, and the glass panel 32 is disposed against the guide 35, or against the vertically extending web of an angle iron which comprises the guide 35. As indicated above, the packing 30 biases the glass against the web and provides an appropriate seal for the fireplace apparatus.

FIG. 12 is a perspective view, partially exploded and partially broken away, of a portion of the apparatus of the present invention, showing details of the duct 81, the air valve 108, the adjacent left side wall or panel 72 of the inner enclosure, and the plate 104 which is disposed above the duct and which extends between the side walls or panels of the inner enclosure.

At the left end of the generally rectangularly configured duct 81 is an end panel 87, which is substantially parallel to, and identical with, the end panel 83 illustrated in FIG. 10, above. The end panel 87 includes a generally square or rectangular aperture 89 cut through the panel. The panel 87 is appropriately secured to the support plate 82, which comprises one wall of the duct, and the bottom plate or panel 84, and the forward panel or wall 88. The panels 82, 84, and 88 may be appropriately secured together, and to the end panels 83 and 87, as be welding. However, the top panel or plate 86 is not welded to the duct, but rather is movably secured to the duct, as by sheet metal screws, bolts, or the like.

The left wall panel 72 includes an aperture 73 extending therethrough which mates with the aperture 89 in the end panel 87 when the duct 81 is secured to the wall 72. As indicated above in conjunction with FIG. 10, and as shown in detail in FIG. 12, the duct 81 is appropriately secured to the wall 72 by means of bolts extending through apertures in the end panel 87. To receive the threaded shanks of the bolts, appropriate nuts may be welded to the wall 72. The bolts are appropriately extended through bolt holes in the end panel 87 and in the wall 72 to the nuts. Substantially the same method and apparatus are used to secure the end panel 83 (see FIG. 10) to the wall 74. The flow of air through the grates between the chamber 38 (see FIG. 3) and the chambers 17 and 21 is through the grates 110 and the duct 81. The duct 81 communicates with the chambers 17 and 21 through the aligned apertures in the end panels and in the inner enclosure walls, as discussed above. The air flow is preferably from the chambers 17 and 21 into the duct 81, and from the duct 81 through the hollow grates to the chamber 38. From the chamber 38, the heated air flows to the lower, or supply, duct 80 and thence outwardly for distribution.

In order to secure and to remove the duct 81 to and from the respective wall panels 72 and 74, access must be available to the inside of the duct 81, and accordingly the access is accomplished by removing the top panel or plate 86 of the duct 81. With the top panel removed, the bolts securing the duct to the side walls are removed, and the duct is then lifted out. With the duct 81 removed from the apparatus, the grates are also removed easily from the fireplace apparatus.

The top plate 104 is disposed above the duct 81 and it is first removed to provide access to the duct and to the grates. The left side of the plate 104 is supported by the horizontally extending web of the angle iron bracket 174. The bracket 174 is shown secured to the inside of the wall 72 above the duct 81.

The air valve 108 is secured to the top plate 86 by means of a pair of brackets 160 and 162 which are appropriately secured, as by welding, to the top panel 86. A pair of pins 161 and 163 are welded to the vane 164 and the pins extend through a pair of apertures in the brackets 160 and 162. As illustrated in FIG. 12, the brackets are preferably a short length of angle iron extending upwardly from the plate 160 with a pair of webs of the angle irons substantially parallel to each other. The webs include apertures through which the pins 161 and 163 extend.

On an end of the pin 163 remote from the vane 164 is a crnak 166. The crank 166 is appropriately secured to the pin 163 and movement of the crank 166 results in rotary movement of the pin 163 and in turn of rotary movement of the vane 164. The rod 168 is in turn secured to one end of the crank 166. Axial movement of the rod 168 results in rotary movement of the crank 166 and also in rotary movement of the vane 164.

Figure 13:
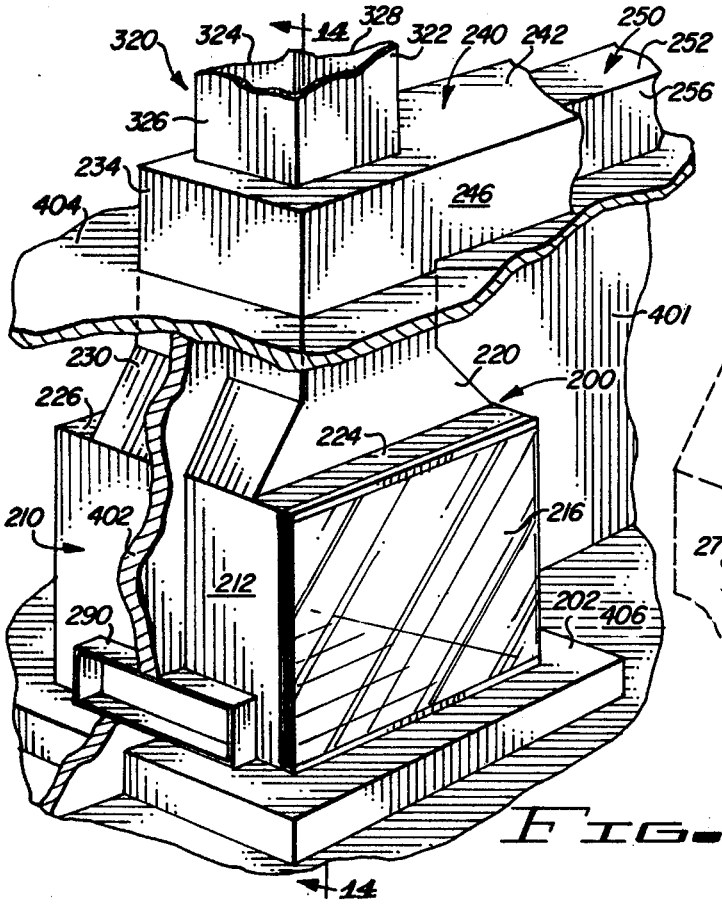
FIG. 13 is a perspective view of an alternate embodiment of the fireplace apparatus of FIGS. 1-8, comprising a dual fireplace.

FIG. 13 is a perspective view of an alternate embodiment of the fireplace apparatus of FIGS. 1–12, comprising dual fireplace apparatus 200. The dual fireplace apparatus 200 illustrates the concept of the apparatus of FIGS. 1–12 used in an outer enclosure which provides for accessibility of the firebox, or the inner enclosure, to be accessible from two adjacent rooms. That is, the fire box or inner enclosure of the fire box apparatus 200 extends into two adjoining rooms, and each room includes a glass front which opens into the inner enclosure and into the firebox at the lower portion of the inner enclosure.

The dual fireplace apparatus 200 is disposed at adjacent ends of, or between, two rooms, the critical portions of which are defined by a pair of walls 401 and 402 and a ceiling 404. The walls 401 and 402 are virtually a continuation of each other, but are separated by the fireplace apparatus 200. For convenience and clarity of illustration, the ceiling 404 is shown to illustrate the ductwork which is disposed within the attic of the home or structure in which the fireplace apparatus 200 is disposed. If desired, the ductwork may be disposed in appropriate space between adjacent floors of a building, as for example if the fireplace apparatus 200 is used on the first floor of a two-story (or multi-story) structure. The fireplace apparatus is disposed on a hearth 190 which is in turn set on the floor 406. The hearth 202 extends into both rooms on either side of the walls 401 and 402 and beneath the fireplace apparatus 200.

The fireplace apparatus includes an outer enclosure or air jacket 210 which has a pair of generally parallel outer walls, of which left outer side wall panel 212 is shown in FIG. 13. At the front and rear of the outer enclosure 210 are a pair of generally parallel glass panels, of which front glass panel 216 is shown in FIG. 13. For convenience, the glass panel 216 is referred to herein as the "front" glass panel, while the glass panel substantially parallel to panel 216, but not shown in FIG. 13, is referred to as the rear glass panel. In other words, the portion of the dual fireplace apparatus 200 illustrated most completely in FIG. 13 is considered as the "front" protion of the fireplace, while the portion beyond the walls 401 and 402 is referred to as the "rear" fireplace. In actuality, of course, there is but a single fireplace, accessible from opposite ends of the fireplace. Above the side panel 212 and extending across the front of the fireplace apparatus, is a front shelf 224. The front shelf 224 is substantially perpendicular to both the left side panel 212 and the front glass panel 216. It extends generally horizontally across the front of the outer enclosure 210 above and behind the front glass panel 216. Extending vertically upwardly from the front shelf 224 is a front vertical panel 220.

Above the left wall panel 212 and sloping inwardly and upwardly is a left sloping panel 230. Extending vertically upwardly from the left vertical panel 230 is a left upper vertical panel 234. The panels 212, 230, and 234 are secured together, and they are also secured, as appropriate, to the shelf panel 224 and the front vertical panel 220. In addition to the panels clearly shown and identified in FIG. 13 and discussed herein, there are similar or corresponding panels to make an integrated whole, as either shown in one of the FIGS. 14, 15, or 16, or as will be understood to be necessary to complete the structure.

Figure 14:
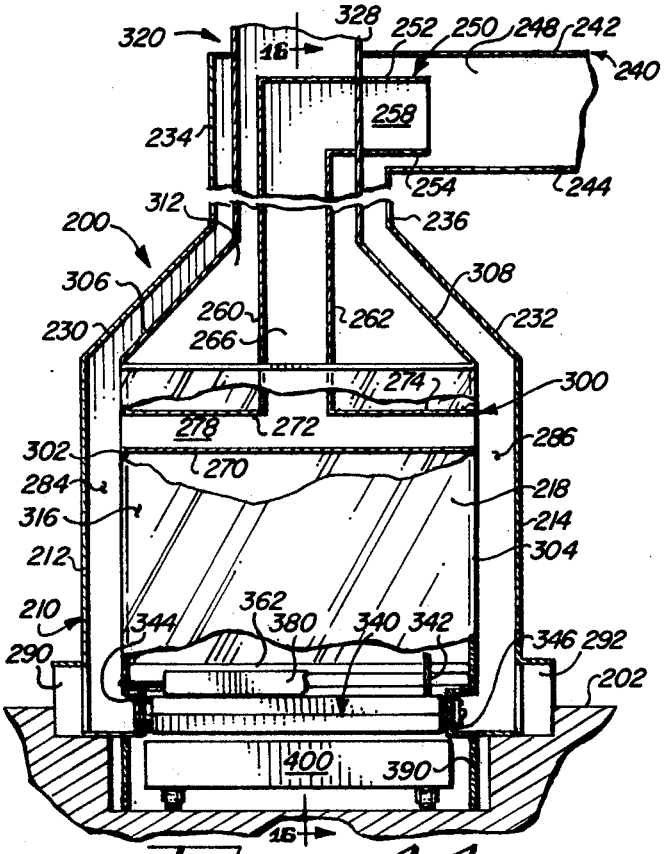
FIG. 14 is a view in partial section of a portion of the apparatus of FIG. 9 taken generally along line 14—14 of FIG. 13.

Substantially in the same plane as the front shelf panel 224, is a rear shelf panel 226. The panel 226 extends across the rear portion of the fireplace apparatus 200 and connects with the left side panel 212 and also with a right side panel, as shown in FIG. 14, below.

At the upper portion of the air jacket or outer enclosure 210, and connected to the outer enclosure, is a horizontally extending outer duct 240. The outer duct 240 is a continuation of the upper portion of the outer enclosure. It includes a top panel 242 and a front panel 246, both of which are shown in FIG. 13.

Extending outwardly from the outer duct 240 is a portion of an inner duct 250. The inner duct 250 includes an upper horizontally extending portion disposed within and substantially parallel to the outer duct 240. The upper horizontally extending portion includes an upper horizontal top panel 252 and an upper vertical front side panel 256, both of which are shown in FIG. 13. The upper horizontal portion of the inner duct 250 includes substantially the same general configuration as does the outer duct 240, which is preferably rectangular.

A combustion gas flue 320 extends upwardly from the central portion of the fireplace apparatus 200. It extends through the top panel 242 of the outer duct 240. The combustion gas flue 320 is generally of a square configuration, and it includes four panels, front panel 322, rear panel 324, left side panel 326, and right side panel 328. The combustion gas flue 320 is preferably of a square configuration to maximize the surface area of the flue subject to the flow of air for the transfer of heat from the combustion gases flowing upwardly through the combustion gas flue to the air flowing through and about the combination gas flue in the inner and outer ducts 250 and 240, respectively, as explained in detail below. As will also be explained below, and illustrated in conjunction with FIGS. 14, 15, and 16, a portion of the inner duct 250 extends into and is disposed within the combustion gas flue 320.

FIG. 14 is a view in partial section of a portion of the apparatus of FIG. 13 taken generally along line 14—14 of FIG. 13. It comprises a partial sectional view looking through the dual fireplace apparatus 200 from front to rear.

The outer enclosure 210 is shown disposed about an inner enclosure 300 which is spaced apart from the outer enclosure to provide for the flow of air about the inner enclosure for the transfer or exchange of heat from the inner explosure to the air circulating or flowing about the inner enclosure. The outer enclosure includes the left side panel 212 and a parallel right side panel 214. Extending upwardly and inwardly from the respective left and right side panels are a pair of sloping panels 230 and 232. The left sloping panel 230 and the right sloping panel 232 extend for a short distance before joining to a pair of generally parallel vertical panels, including left vertical panel 234 and right vertical panel 236. The left vertical panel 234 extends above the right vertical panel 236 and becomes the end panel for the outer duct 240. The top panel 242 of the outer duct 240 extends horizontally from the upper portion of the left vertical panel 234. The right vertical panel 236 extends upwardly to where it joins with a bottom panel 244 of the outer duct 240. Extending between the top and bottom panels 242 and 244 of the outer duct 240 is a rear panel 248, which is substantially parallel to the front panel 246, shown in FIG. 13.

The inner enclosure 300 includes a left side panel 302 and a right side panel 304, which are substantially parallel to each other and to their adjacent side panels 212 and 214, respectively, of the outer enclosure 210. Extending inwardly and upwardly from the top of the side panels 302 and 304 are a pair of upwardly and inwardly extending sloping panels 306 and 308. The panel 306 comprises a left upper inclined panel and the panel 308 comprises a right upper inclined panel for the inner enclosure. The combustion gas flue 320 is connected to the top of the upper inclined panels 306 and 308. The lower portion of the inner enclosure, below the combustion gas flue 320, comprises a combustion chamber 316.

Figure 16:
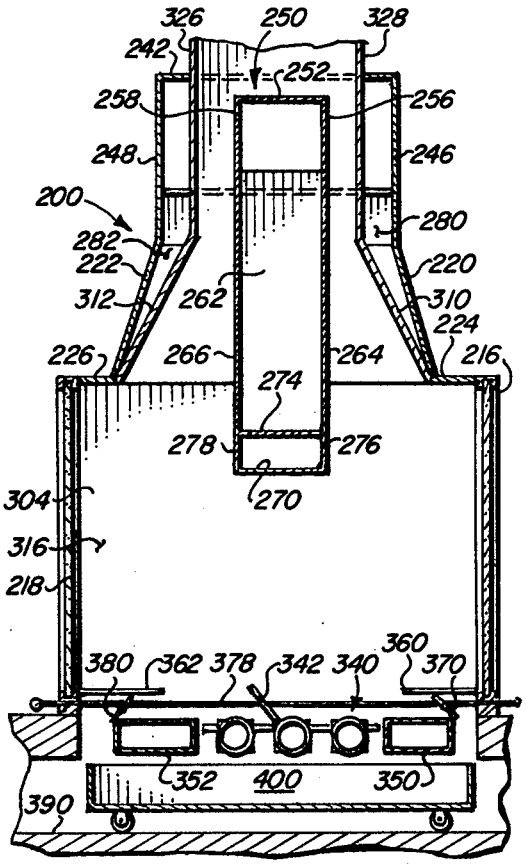
FIG. 16 is a view in partial section of a portion of the apparatus of FIG. 10, taken generally along line 16—16 of FIG. 14.

The combustion gas flue 320, as discussed above in conjunction with FIG. 13, is generally square in cross sectional configuration, and accordingly the upper portion of the inner enclosure includes four sloping wall panels, two of which extend inwardly and upwardly from the lower enclosure side panels, and two of which extend inwardly and upwardly from adjacent the shelves 224 and 226, as shown in FIG. 16. In addition to the sloping side panels 306 and 308, a sloping rear panel 312 is also shown in FIG. 14.

The inner duct 250 is shown in FIG. 14 as being disposed within a portion of the outer duct 240 and also within the combustion gas flue 320. The horizontally extending portion of the inner duct, including the upper horizontal top panel 252, the upper horizontal bottom panel 254, and the upper vertical front side 256 (see FIGS. 13 and 15), and the upper horizontal rear side 258, extends through the right side panel 328 of the combustion gas flue 320 and into the center of the combustion gas flue, where the inner duct makes a substantially right angle bend or turn and extends downwardly within the combustion gas flue where the inner duct terminates in another horizontally extending portion within the combustion chamber 316 of the inner enclosure.

The vertically extending portion of the inner duct 250 is also preferably of a square rectangular configuration, and it includes four sides, including a left vertical side panel 260, a right vertical side panel 262, a front vertical side panel 264 (see FIGS. 15 and 16) and a rear vertical side panel 266. At the bottom of the vertically extending portion of the inner duct 250 is a horizontally extending portion of the duct which communicates with chambers 284 and 286 defined between the left and right portions of the inner enclosure and the outer enclosure, respectively. The horizontally extending duct portion includes a bottom horizontally extending panel 270 which extends between, and is appropriately secured to, the left and right side panels 302 and 304, respectively. Parallel to the bottom panel 270 are a pair of upper panels, including upper left panel 272 and upper right panel 274. The panels 272 and 274 are generally aligned in the same plane and are substantially parallel to the bottom panel 270. A lower horizontally extending portion of the inner duct 250 is completed by a pair of parallel lower side panels, including lower front side panel 276 (see FIGS. 15 and 16) and lower rear side panel 278. The lower front and rear side panels comprise horizontally extending portions or extensions of the vertically extending front and rear side panels 264 and 266, respectively, as may be seen from FIGS. 15 and 16. The lower side panels 276 and 278 are also secured to the side panels 302 and 304 and they define, with the panels 270, 272 and 274, a pair of openings or apertures in the side panels which provide communication with the chambers 284 and 286 between the inner enclosure 300 and the outer enclosure 210.

The inner duct 250 serves to provide communiction for the air flow between the inner and outer ducts and within the combustion gas flue 320. The inner duct terminates within the outer duct 240 and thus the air flow from the inner duct and the outer ducts separate within the outer duct.

As with the embodiment of FIGS. 1–12, the direction of the heated air flow is preferably downwardly from the upper portion of the dual fireplace apparatus 200, between the inner and outer enclosures, and about and also through the combustion gas flue, to appropriate distribution ducts at the lower portion of the outer enclosure 210.

Referring both to FIGS. 13 and 14, the chamber 284 communicates directly with a distribution duct 290 disposed at the lower portion of the side panel 212. Another distribution duct 292 is shown in FIG. 14 communicating with chamber 286.

At the bottom portion of the fireplace apparatus 200, and within the inner enclousre 300, are a plurality of grates 340. The grates 340 are substantially identical to the grates 110 illustrated above in conjunction with the embodiment of FIGS. 1–12. That is, each grate comprises a generally square, elongaged, tubular hollow member with a cylindrical connector and bearing portion secured to each end and disposed in a support bracket. The grates are hollow, as are the cylindrical connector portions, to allow for the flow of air through them. The primary difference between the grates 340 and the grates 110 is not in their construction, but rather in their orientation with respect to the fireplace apparatus. Since the fireplace apparatus 200 is a double or dual fireplace, with openings at the front and the rear of the fireplace into adjacent rooms, the grates 340 extend transversely across the fireplace, or from side to side, rather than from front to rear as in the embodiment of FIGS. 1–12.

The grates 340 are secured together by a connector bar, such as connector bar 124 shown in FIGS. 4 and 5, which is in turn secured to each grate by a pin extending outwardly from the cylindrical connector portion of the grates. However, due to the construction of the dual fireplace, the grates are rotated only by a pin 342 extending upwardly from one of the grates.

The grates 340 are supported in a pair of support brackets 344 and 346 which are in turn secured to the bottom of the inner enclosure 300. The brackets include a plurality of apertures into which the cylindrical portion of the grates extends. The spacing of the brackets is such that if a cylindrical portion of a grate is extended fully into the aperture, with the square tubing of the grate against the bracket, the opposite end of the grate will be free from its bracket. In this manner the grates are removed from the fireplace apparatus.

With the grates extending transversely across the fireplace apparatus, the ends of the grates communicate directly with chambers 284 and 268, thus obviating the need for a duct, such as required in the embodiment of FIGS. 1–12. However, if three or four room openings were used, instead of the two illustrated herein, one or both of the chambers 284 and 286 would be eliminated and at least a pair of vertical conduits or ducts would be disposed at the corners of the apparatus with the grates and ducts at the bottom of the apparatus. Accordingly, at least one duct would be necessary to communicate with the grates and with the vertical corner ducts.

A pair of plates extends inwardly from the front and rear of the fireplaces. That is, one plate extends inwardly from the front of the fireplace, at the lower portion of the front glass panel 216, and another plate, a plate 362, extends inwardly from the rear of the fireplace, adjacent glass panel 218. The plates extend substantially horizontally and serve as floor plates for the fireplaces. The plates accordingly are a combination of the fillets, illustrated above in conjunction with the embodiment of FIGS. 1–12, and the front floor plate 104, as shown in FIG. 2. One of the plates, the floor plate 362, is shown in FIG. 14. The plate may be secured and supported as appropriate and well known in the art.

Beneath the grates 340 is an ash cart 400, which is disposed in a passageway 390 through which combustion air flows. The combustion air for the fireplace apparatus 200 flows in substantially the same manner as illustrated above in conjunction with the embodiment of FIGS. 1–12. That is, the combustion air flows into the fireplace apparatus from beneath the apparatus and flows upwardly and horizontally inwardly over the grates. The flow of combustion air into the dual fireplace apparatus is controlled by a pair of air valves, one disposed at the front and one at the rear of the dual fireplace apparatus. An air valve 380 is shown in FIG. 10. The pair of air valves are joined together, as shown in FIGS. 16–21, and discussed in conjunction therewith, below.

Figure 15:
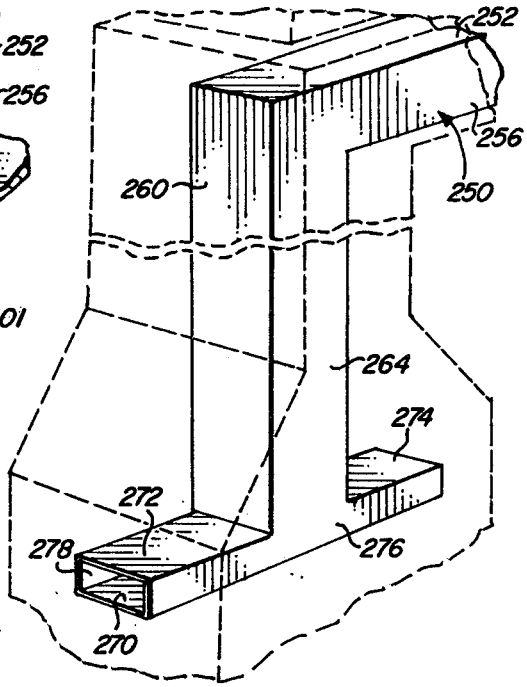
FIG. 15 is a perspective view of a portion of the ducting included in the apparatus of FIGS. 13 and 14.

FIG. 15 is a perspective view of a portion of the duct work illustrated in FIGS. 13 and 14, comprising an illustration of the inner duct 250 in relation to the fireplace apparatus shown in phantom disposed about the inner duct. The inner duct includes a pair of generally horizontally extending portions and a vertically extending portion. The vertically extending portion is generally of a square configuration and is disposed within the combustion gas flue 320, as shown in FIGS. 13 and 14. In FIG. 15, left vertical side 260 and front vertical side 264 are shown as being secured together and disposed at substantially a right angle to each other.

The upper horizontal front side 256 extends outwardly from, and is substantially a continuation of, the front vertical side 264. The upper horizontal top panel 252 is secured to the upper horizontal front side panel 256 and to the left vertical side panel 260, and also to the left vertical side panel and the left horizontal side panel, as shown in FIG. 14. The upper horizontally extending portion of the inner duct 250 is disposed partially within the combustion gas flue and partially within the outer duct 240, (see FIGS. 13 and 14) where it terminates. The horizontally extending portion extends through, and is sealingly secured to, the right side panel 328 of the combustion gas flue 320 (see FIG. 14).

The bottom or lower horizontally extending portion of the inner duct is disposed at the top portion of the fire box, or combustion chamber 316 and extends outwardly to the side panels 302 and 304 of the inner enclosure 300, as shown in FIG. 14. The horizontally extending portion includes a bottom panel 270 and a pair of upper or top panels, including upper left panel 272 and upper right panel 274, both of which are substantially parallel to, and spaced apart from, the bottom panel 270. The upper panels are secured to the vertically extending panels 260 and 262, respectively, as shown in FIGS. 14 and 15. The horizontally extending portion of the inner duct is completed with a pair of lower side panels, including front side panel 276 and rear side panel 278. The side panels are also vertically extending, and comprise an extension of the vertical side panels 264 and 266, also as shown in FIGS. 14 and 15.

The horizontally extending lower portion of the inner duct is generally rectangular in configuration and extends outwardly to the side panels of the inner enclosure to which the horizontally extending portion is sealingly secured. The juncture of the horizontally extending portion of the inner duct with the side panels 302 and 304 define a pair of rectangular apertures which allow direct communication with the heated or ducted air which circulates or flows between the inner enclosure and the outer enclosure in chambers 284 and 286, as illustrated in FIG. 14.

FIG. 16 is a view in partial section of the apparatus of FIG. 14, taken generally along lines 16—16 of FIG. 14. It comprises a side view in partial section of the dual fireplace apparatus 200. The view in FIG. 16 is looking toward the right side of the fireplace apparatus 200.

At the front and rear of the dual fireplace apparatus 200 are the glass panels 216 and 218, respectively. They are disposed in appropriate channels or guides for horizontal movement to allow communication with the interior of the inner enclosure, which comprises the firebox or combustion chamber, similar to the embodiment of FIGS. 1–12. Extending inwardly from the upper portion of the firebox at the front and rear of the fireplace apparatus 200 are a pair of shelves, including the front shelf 224 and the rear shelf 226. The upper walls of the inner and outer enclosures join together at the inward portions of the front shelves and extend upwardly and inwardly therefrom, at diverging angles, to define a pair of front and rear chambers 280 and 282, respectively. The walls 220 and 222 of the outer enclosure extend upwardly at a greater angle than do the inner enclosure panels 310 and 312. There is accordingly an increasing amount of space in the chambers between the inner and outer enclosures, as defined by the walls, to provide for the flow of circulating or heated air therein. The front and rear panels 246 and 248 of the outer duct 240 extend upwardly from the panels 220 and 222, respectively. With respect to the inner enclosure, the wall panels 328 and 326 extend upwardly from the sloping walls 310 and 312 of the inner enclosure, respectively. The chambers 280 and 282 communicate with the upper portions of the chambers 284 and 286 and with the outer duct 240, as may be understood from FIGS. 14 and 16.

The combustion gases from the interior of the fireplace apparatus flow upwardly and about the inner duct 250, and within the outer duct 240, and the circulated air flowing within the inner and outer ducts is accordingly heated. The inner duct 250 includes the vertically extending panels 262, 264, and 266, which extend between the upper and lower horizontally extending duct portions, which include respectively, the panels 252, 256, 258, and the panels 270, 274, and 276, as shown in FIG. 12.

At the lower portion of the fireplace apparatus are a pair of horizontally disposed plates 360 and 362, extending inwardly toward the grates 340 from the front and rear portions of the fireplace, respectively. A pair of rectangularly configured fixed ducts 350 and 352 are disposed adjacent the grates and beneath the plates. The ducts extend between and are secured to the side walls 302 and 304 of the inner enclosure 300. The ducts provide for the flow of air between the chambers 284 and 286 (see FIG. 14), as do the grates 340. However, unlike the grates, the ducts 350 and 352 are fixed and are not movable.

Within the passageway 390 is shown the ash cart 400 disposed beneath the grates 340. The pin 342 is shown extending upwardly, and disposed at an angle, with respect to the grates 340, which are shown in the dump position. With the grates in the dump position, the sides of the square tubular grates are disposed horizontally, and perpendicular to the horizontal (or vertical), which provides for a maximum spacing between the adjacent grates. When the grates are turned as shown in FIG. 16, the ashes collecting above or on top of the grates during combustion are allowed to fall between the grates into the ash cart 400 disposed below the grates in the passageway 390.

Combustion air flowing in the passageway 390 flows upwardly into the combustion chamber beneath the plates 360 and 362. The flow of combustion air is controlled by a pair of air valves 370 and 380, disposed respectively beneath the plates 360 and 362. The air valves are connected by a rod 378 which allows both dampers to move simultaneously to control the flow of air inwardly over the grates. The air valves 370 and 380 are generally parallel to each other and they are supported at their ends for rotary movement to open or to close the space between the fixed ducts and the floor plates which in turn control the flow of air into the firebox 316 of the fireplace apparatus 200 from the passageway 390.

Figure 17:
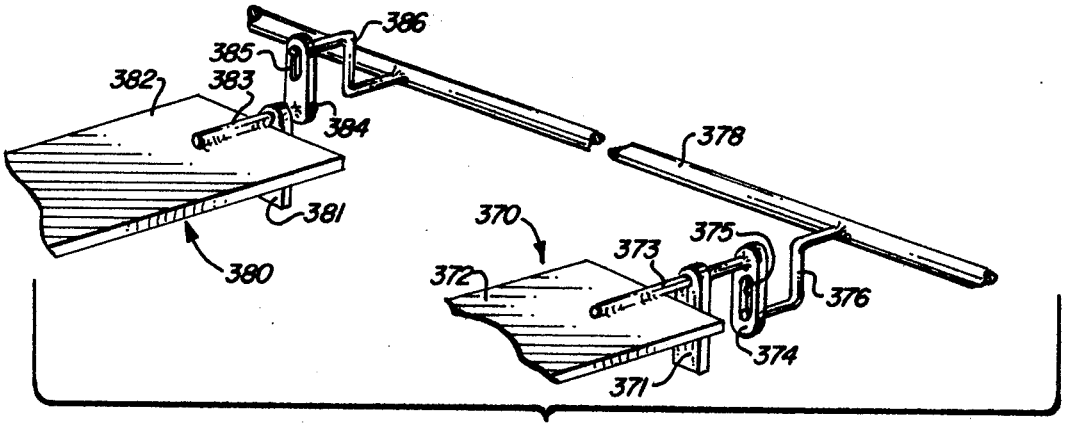
FIG. 17 is a perspective view of the air valves and linkage of the alternate embodiment of the present invention.

FIG. 17 is a perspective view showing the single linkage to the dual air valves 370 and 380 in the alternate embodiment of FIGS. 13–16. The air valves 370 and 380 are connected by a single connecting rod 378 which extends, as shown in FIG. 16, through both sides of the fireplace and the air valves are accordingly actuable from both sides.

The air valve 370 includes a vertically extending support bracket 371. A vane 372 is supported by the support bracket 371 by means of a pin 373 which extends through an aperture or hole in the upper portion of the bracket 371 and is appropriately secured, as by welding, to the vane 372. The pin 373 is in turn secured to a crank arm 374, also as by welding. Accordingly, the rotary movement of the crank arm 374 will result in rotary movement of the pin 373 and of the vane 372 secured to the pin 373. The hole or aperture in the vertical support 371 accordingly becomes the pivot point for the vane and the air valve apparatus.

A slot 375 extends through the crank arm 374. One end of a crank 376 is disposed in the slot 374 and the opposite end of the crank 376 is secured, as by welding, to the connecting rod 378. The crank 376 includes two parallel and oppositely extending or offset, spaced apart portions connected by a center section. The parallel but offset portions respectively are connected to the crank arm 374 and the rod 378, as illustrated.

The air valve 380 is substantially identical to the air valve 370, with only a difference in the orientation of the crank arms of the two air valves. The air valve 380 includes a support bracket 381, substantially identical to the support bracket 371, with a vane 382 secured to a pin 383 that extends through a hole or aperture in the support bracket 381. The pin 383 is secured to a crank arm 384 remotely from the vane 382. The crank arm 384 includes a slot 385 which receives one end of a crank 386, which is substantially identical to the crank 376. The crank 386 is also secured to the connecting rod 378.

The air valves 370 and 380 move together, but in opposite directions. In order to accomplish the opposite direction movement, the crank arms 374 and 384 extend oppositely with respect to each other by one hundred eighty degrees. As indicated in FIG. 17, both vanes 372 and 382 are substantially horizontally disposed. The crank 374 is shown extending vertically downwardly with respect to the pin 373, while the crank 384 extends vertically upwardly with respect to its pin 383. The respective cranks 376 and 386 are correspondingly oppositely directed.

Figure 18:
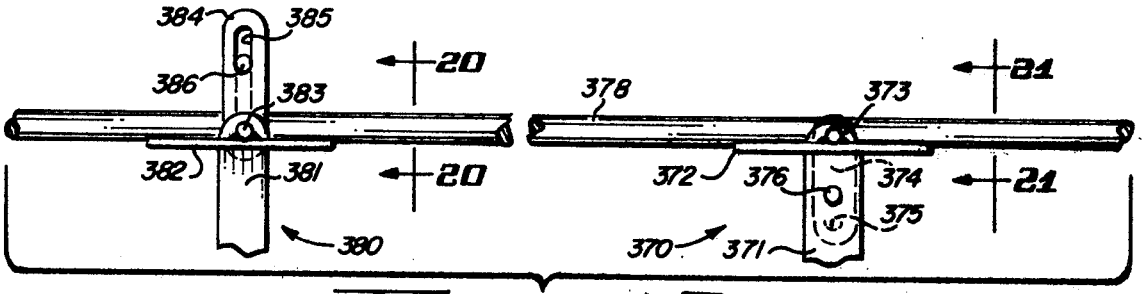
FIGS. 18 and 19 are side views of the apparatus of FIG. 17, showing sequential movement of the air valve linkage.

FIG. 18 is a side view of the apparatus of FIG. 17, showing the orientation of the various portions of the air valves 370 and 380 and the same general orientation as illustrated in FIG. 17. In FIG. 18, the connecting rod 378 is substantially horizontally disposed, as are the vanes 372 and 382. The cranks 374 and 384 are substantially perpendicular to the respective vanes 372 and 382, and are oppositely directed with respect to each other. That is, the crank 374, while generally parallel to the bracket 371, extends downwardly from the pin 73 and the vane 372, while the crank 384 extends upwardly with respect to the bracket 381 and the vane 382. One end of each of the cranks 376 and 386 are disposed in the slots 375 and 385, respectively. It will be noted that the crank 376 is disposed in the upper or top portion of the slot 375, while the end of crank 376 is disposed in the lower portion of the slot 385.

Figure 19:
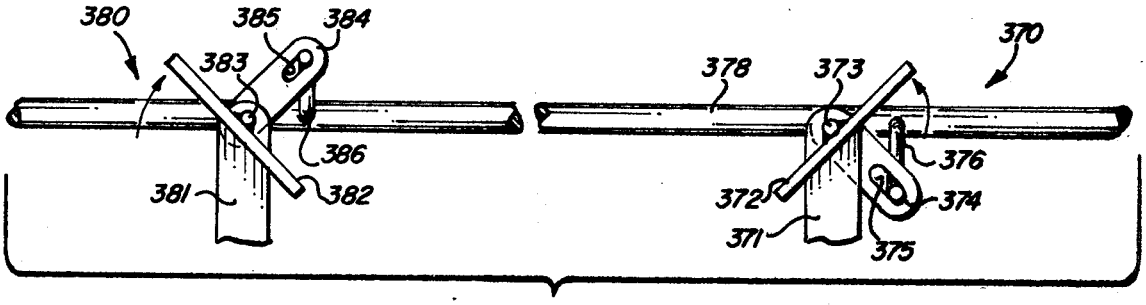

FIG. 19 is a view of the apparatus of FIG. 18 illustrating movement of the respective vanes 372 and 382 of the air valves 370 and 380 after a longitudinal movement of the connecting rod 383 has been accomplished in a direction toward the right as viewed in FIG. 19.

A rightward movement of the connecting rod 378 results in a rightward movement of the crank 376 which is secured to the rod 378. Since one end of the crank 376, the end remote from the connecting rod 378, extends into the slot 375 of the crank arm 374, the crank arm 374 will be pivoted about its pivot point on the rod 373, which extends through the support bracket 371. The pivoting movement of the crank arm 374 results in a rotary movement of the pin 373 and there is a corresponding rotary or pivoting movement of the vane 372 about the rod 373. The vane 372 accordingly moves upwardly to the position shown in FIG. 19.

A corresponding movement of the vane 382 has been accomplished in response to the movement of the connecting rod 378. The crank 386, secured to the rod 378, moves laterally to the right and the end of the crank 386 which extends into the slot 385 moves in the slot and results in rotary movement of the crank arm 384 about is pivot point defined by the pin 383 which extends through the vertical support bracket 381. The rotary movement of the crank arm 384 results in rotary movement of the pin 383 and a corresponding rotary movement of the vane 382 is accomplished. The outer end of the vane 382 moves upwardly, to the position indicated in FIG. 19.

The movements of the vanes 372 and 382 are in directions opposite each other, but the movements are corresponding and are accomplished in substantially the same manner. Remembering, as discussed above, that the air flow through the air valves will be inwardly directed with respect to the apparatus of FIG. 19, or toward the center of the figure, between the vanes, the movement of the vanes is substantially identical with respect to the air flow through the air valves.

Figure 20:
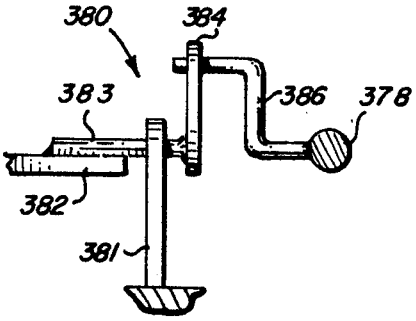
FIGS. 20 and 21 are end views of the apparatus of FIG. 18 taken generally along lines 20—20 and 21—21, respectively, of FIG. 18.

FIG. 20 is a view of the apparatus of FIG. 18 taken generally along line 20—20 of FIG. 18. The relationship between the vertical support bracket 381 is clearly shown. The pin 383 extends through the upper portion of the bracket 381 and is secured to the vane on one side of the bracket and to the crank arm 384 on the opposite side of the bracket, remote from the vane 382. The crank 386 extends through the bracket 384 at one end and is secured to the connecting rod 378 at its opposite end. It may be clearly seen that the crank arm 384 extends vertically with respect to the vane 382 and the support bracket 381.

Figure 21:
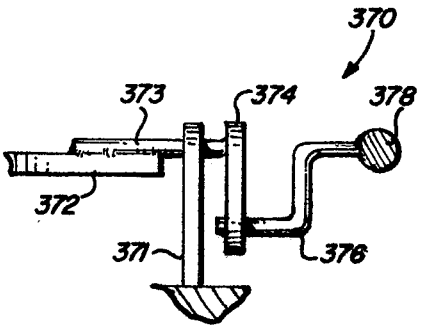

FIG. 21 is a view of the apparatus of FIG. 18 taken generally along line 21—21 of FIG. 18. It shows the air valve 370 with its vane 372 in substantially the horizontal position, as shown in both FIGS. 17 and 18. The pin 373 extends through the vertical support bracket 371 and is secured on one end to the vane 372 and on its opposite end to one end of the crank arm 374. The crank 376 is secured at one end to the connecting rod 378 and at its opposite end to the end of crank arm 374 remote from the pin 373. As illustrated in FIGS. 18 and 19, the crank 376 extends through a slot in the crank arm 374.

The crank arm 374 extends vertically downwardly with respect to the vane 372, and is in general a parallel alignment with respect to the support bracket 371. The position of the crank arm 374 is substantially 180 degrees opposite that of the crank arm 384, as shown in FIG. 20. The respective orientation of the crank arms, and of the cranks secured to the connecting rods 378 and to the crank arms, results in a coordinated but opposite movement of the vane of the air valves, as illustrated and discussed above.

What is claimed is:

1. Fireplace furnace apparatus comprising, in combination:

inner enclosure means including a plurality of walls defining a firebox;

outer enclosure means including a plurality of walls disposed about and spaced apart from the inner enclosure means and defining a plurality of chambers between the inner enclosure means and the outer enclosure means;

upper duct means communicating with the plurality of chambers to provide a flow of circulating air comprising a first flow of air to the chambers for receiving heat from the plurality of walls of the inner enclosure;

lower duct means communicating with the plurality of chambers remote from upper duct means for transmitting the first flow of heated air from the chambers;

grate means disposed beneath the firebox and including a plurality of noncylindrical rotatable hollow members communicating with the plurality of chambers for transmitting a portion of the first flow of air between some of the plurality of chambers and for supporting fuel for combustion in the firebox, and means for rotating the rotatable hollow members between a first position in which portions of the hollow members are disposed adjacent each other for preventing a vertical flow of combustion air between the hollow members and a second position in which portions of the hollow members are spaced apart from each other to allow ash residue from the combusted fuel to fall beneath the grate means;

means for providing a flow of combustion air comprising a second flow of air over the grate means;

air valve means for controlling the second flow of combustion air over the grate means; and a combustion flue communicating with the firebox for removing the second flow of air from the firebox.

2. The apparatus of claim 1 in which the outer enclosure means includes panel means for providing access to the firebox and for sealing the firebox to maintain separate the first and second flows of air.

3. The apparatus of claim 2 in which the upper duct means includes a plurality of miniature ducts extending through the combustion flue to provide for the passage of the first flow of air through the combustion flue.

4. The apparatus of claim 3 in which the grate means further includes a duct connected to and supporting one end of each of the elongated hollow members and connecting the inner enclosure means and communicating with some of the plurality of chambers through the inner enclosure means.

5. The apparatus of claim 3 in which the means for providing the second flow of combustion air comprises a passageway terminating adjacent and above the grate means within the inner enclosure means.

6. The apparatus of claim 5 in which the air valve means comprises a vane disposed in the passageway and movable in the passageway to control the second flow of air from the passageway to the inner enclosure means.

7. The apparatus of claim 3 in which the means for rotating the rotatable hollow members of the grate means includes linkage connecting the hollow members together.

8. The apparatus of claim 7 in which the grate means includes a duct secured to the inner enclosure means and communicating with the plurality of chambers through the inner enclosure means and the linkage is disposed within the duct.

9. The apparatus of claim 2 in which the panel means includes a plurality of panels spaced apart from each other for providing access to the firebox from different locations.

10. The apparatus of claim 9 in which the means for providing the second flow of combustion air comprises a passageway terminating at the firebox above the grate means.

11. The apparatus of claim 10 in which the air valve means includes a pair of vanes.

* * * * *